US007428985B1

(12) United States Patent
Moreland et al.

(10) Patent No.: US 7,428,985 B1
(45) Date of Patent: Sep. 30, 2008

(54) COMPUTERIZED DROP SAFE AND CONTROL SOFTWARE

(75) Inventors: Flynt M. Moreland, Plano, TX (US); James Hoffmaster, Rockwall, TX (US); Todd Dillen, Flower Mound, TX (US)

(73) Assignee: Tidel Engineering, L.P., Carrollton, TX (US)

( * ) Notice: Subject to any disclaimer, the term of this patent is extended or adjusted under 35 U.S.C. 154(b) by 0 days.

(21) Appl. No.: 11/762,305

(22) Filed: Jun. 13, 2007

Related U.S. Application Data

(62) Division of application No. 10/896,414, filed on Jul. 22, 2004, now Pat. No. 7,264,150.

(51) Int. Cl.
*G07F 7/04* (2006.01)

(52) U.S. Cl. ..... 235/379; 194/206

(58) Field of Classification Search ..... 235/379; 194/206, 217, 302; 902/11, 13
See application file for complete search history.

(56) References Cited

U.S. PATENT DOCUMENTS 5,209,395 A 5/1993 Zouzoulas et al.
5,321,242 A 6/1994 Heath, Jr.
5,366,404 A 11/1994 Jones
5,451,757 A 9/1995 Heath, Jr.
5,675,780 A 10/1997 Plant-Mason et al.
5,695,038 A 12/1997 Keith, III et al.
5,725,081 A 3/1998 Meeker
5,742,034 A 4/1998 Meeker
5,870,746 A 2/1999 Knutson et al.
5,883,371 A 3/1999 Meeker
5,944,163 A 8/1999 Keith, III et al.
5,975,275 A 11/1999 Keith, III et al.
6,055,541 A 4/2000 Solecki et al.

(Continued)

OTHER PUBLICATIONS

The Auditor Series Training Manual, Tidel Manufacturing Company (TMC), Sep. 10, 1996.
Bennet, Stephen, Safe and Sound, National Petroleum News, Aug. 2003.
Gilbert, H.; Browser Javascript and VB Script, PC Lube and Tune (1996).

*Primary Examiner*—Daniel A Hess
(74) *Attorney, Agent, or Firm*—Locke Lord Bissell & Liddell, LLP

(57) ABSTRACT

A computerized drop safe running control and security software on a central processing unit controlling (CPU) operating features on and access to the drop safe. A user hierarchy has different access policies for making different transactions into the safe. Vault door access is controlled by the CPU to allow user access according to enabled policies. Transactions into and out of the safe vaults, motovend tube dispenser, and currency recyclers are recorded by the amounts and the user making the transaction into a memory coupled to the CPU. This data is also reported to a point of sale control interface at another location using a modem or Ethernet connection. The CPU can also receive data and control inputs by the modem and Ethernet, permitting centralized accounting and vending control options. A back office at the store can also easily access the safe for data retrieval or control inputs into the CPU using an Ethernet local area network computer system.

14 Claims, 24 Drawing Sheets

U.S. PATENT DOCUMENTS

| | | | |
|---|---|---|---|
| 6,067,530 | A | 5/2000 | Brooks, Jr. et al. |
| 6,213,341 | B1 | 4/2001 | Keith, III et al. |
| 6,233,583 | B1 | 5/2001 | Hoth |
| 6,318,134 | B1 | 11/2001 | Mossberg et al. |
| 6,724,303 | B2 | 4/2003 | McGunn et al. |
| 6,885,281 | B2 | 4/2005 | McGunn et al. |
| 2002/0063034 | A1 | 5/2002 | Dobbins |
| 2006/0253332 | A1 | 11/2006 | Dobbins |

FIG. 1
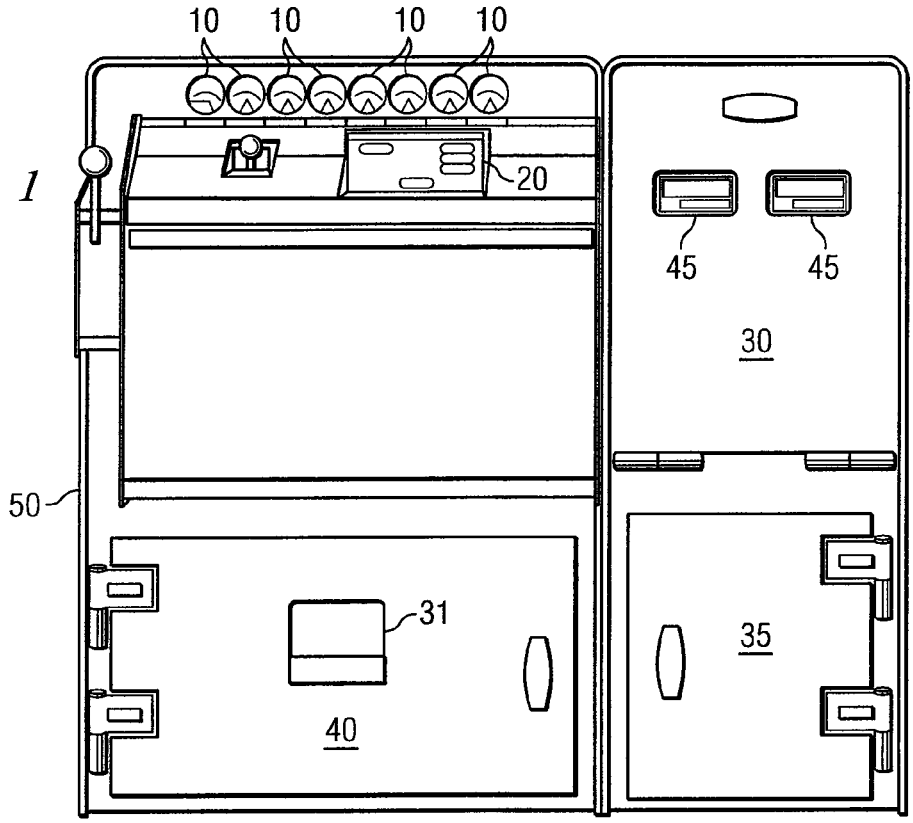
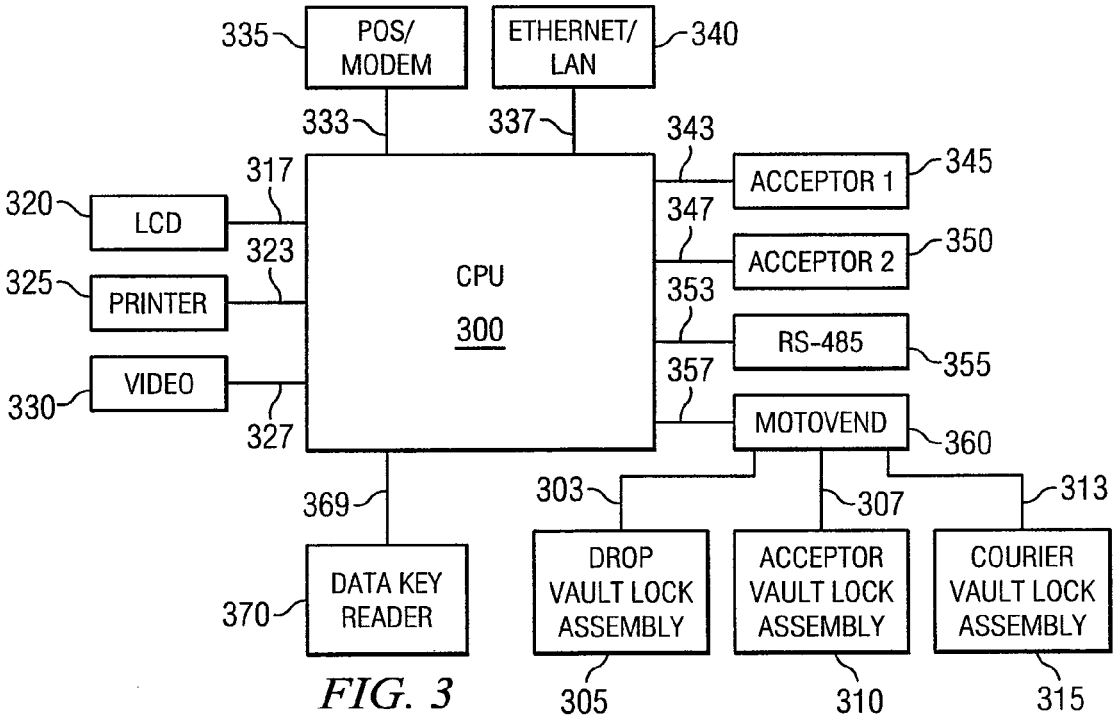
FIG. 3

FIG. 9

900

905 Total Drop Report
910 08-15-02 15:45

| 915 | 920 | 925 | 930 |
|---|---|---|---|
| 08-14-02 09:44 | Name | Check | 50.00 |
| 08-14-02 12:15 | Name | Cash | 20.00 |
| 08-14-02 17:15 | Name | Other | 100.00 |
| 08-15-02 10:03 | Name | Check | 25.30 |
| 08-15-02 13:22 | Name | Check | 14.98 |

935 Total Cash: 20.00
940 Total Checks: 90.28
950 Total Other: 100.00
955 End Total Drop Report

FIG. 10

1000

1005 Transaction Report
1010 Printed at 08-26-2002 12:02
1015 08-25-2002 11:53 to 08-26-2002 12:02

| 1020 | 1025 | 1030 |
|---|---|---|
| 08-25-02 12:30 | MgrName | Vault Open Request |
| 08-25-02 12:42 | MgrName | Door Opened |
| 08-25-02 12:55 | Door Closed | |
| 08-25-02 15:48 | ClerkName | Vend $10 col 4 |
| 08-25-03 19:33 to drop | ClerkName | Transfer check 36.40 from outside |
| 08-25-02 20:34 | ClerkName | Drop chute open |
| 08-25-02 20:34 | Drop chute close | |
| 08-25-02 22:25 | MgrName | Manager load $4 2 tubes col 2 |
| 08-26-02 09:02 | CourierName | Courier key |
| 08-26-02 09:02 | CourierName | Door opened |
| 08-26-02 09:08 | Door closed | |

1035 End Transaction Report

FIG. 11

1100

1105 Courier Deposit Report
1110 08-29-2002 14:02
1115 CourierName
1120 CourierName deposited $100.00 into the main vault
1125 End Courier Deposit Report

1200

*FIG. 12*

1205 Courier Withdrawal Report
1210 For Store: StoreName
1215 Printed on 11-06-2002 07:03

1220 Printed by: CourierName 1225
11-05-2002 7:25 AM
to
11-06-2002 7:03 AM

1230 Total value of pickup $ 100.35
1235 There should be cash totaling 25.35.
1240 There should be check (s) totaling 70.00

1245 BILLS ACCEPTOR CONTENTS

| Denom | 1 | 2 | 1247 Total | 1248 Value |
|---|---|---|---|---|
| $1 | 0 | 0 | 0 | $0 |
| $2 | 0 | 0 | 0 | $0 |
| $5 | 1 | 0 | 1 | $5 |
| $10 | 0 | 0 | 0 | $0 |
| $20 | 0 | 0 | 0 | $0 |
| $50 | 0 | 0 | 0 | $0 |
| $100 | 0 | 0 | 0 | $0 |
| Unrecognized | 0 | 0 | 0 | $0 |
| All | 1 | 0 | 1 | $5 |

1246

1250 Breakdown by business day

Business day ending 11-06-2002 7:03 AM 1251

| | | |
|---|---|---|
| Acceptor cash: | $ 5.00 | 1252 |
| Courier tray cash deposits: | $ 25.35 | 1253 |
| Courier tray check deposits: | $ 70.00 | 1254 |
| Courier tray "other" deposits: | $ 0.00 | 1255 |
| Total deposit value: | $ 100.35 | 1256 |

Business day ending 11-05-2002 7:25 AM

| | |
|---|---|
| Acceptor cash: | $ 35.00 |
| Courier tray cash deposits: | $ 200.00 |
| Courier tray check deposits: | $ 50.00 |
| Courier tray "other" deposits: | $ 0.00 |
| Total deposit value: | $ 285.00 |

1260 End Courier Withdrawal Report

1300

*FIG. 13*

1305 Courier Context Report
1310 For Store: StoreName
1315 Printed on 11-06-2002 07:03 AM
1320 Printed by UserName
1325 11-05-2002 7:25 AM
to
11-06-2002 7:03 AM 1330 Totals for period:

| | | |
|---|---|---|
| Acceptor cash: | $ 40.00 | 1331 |
| Courier tray cash deposits: | $ 225.35 | 1332 |
| Courier tray check deposits: | $ 120.00 | 1333 |
| Courier tray "other" deposits: | $ 0.00 | 1334 |
| Total deposit value: | $ 385.35 | 1335 |

1340 Breakdown by business day

Business day ending 11-06-2002 7:03 AM 1341

| | | |
|---|---|---|
| Acceptor cash: | $ 5.00 | 1342 |
| Courier tray cash deposits: | $ 25.35 | 1343 |
| Courier tray check deposits: | $ 70.00 | 1344 |
| Courier tray "other" deposits: | $ 0.00 | 1345 |
| Total deposit value: | $ 100.35 | 1346 |

Business day ending 11-05-2002 7:25 AM

| | |
|---|---|
| Acceptor cash: | $ 35.00 |
| Courier tray cash deposits: | $ 200.00 |
| Courier tray check deposits: | $ 50.00 |
| Courier tray "other" deposits: | $ 0.00 |
| Total deposit value: | $ 285.00 |

1355 End Courier Content Report

*FIG. 14*

1400

1405 Current Content Report
1410 For Store: StoreName
1415 Printed on 11-06-2002 07:03 AM
1420 Printed by UserName

| | | |
|---|---|---|
| 1425 | Current Vault Drop (cash) | 40.00 |
| 1430 | Current Vault Drop (check) | 0.00 |
| 1435 | Current Vault Drop (other) | 0.00 |
| 1440 | Current Vault Drop (Total) | 40.00 |
| 1445 | Current Vault | |
| 1446 | (Cash) | 40.00 |
| 1447 | (Check) | 0.00 |
| 1448 | (Other) | 0.00 |
| 1449 | (Total) | 0.00 |
| 1450 | Current Courier Tray (Cash) | 0.00 |
| 1455 | Current Courier Tray (Check) | 0.00 |
| 1460 | Current Courier Tray (Other) | 0.00 |
| 1465 | Current Courier Tray (Total) | 0.00 |

1470 COLUMN CONTENTS

| Col Num (1471) | Tube Count (1472) | Tube Value (1473) | Col Total (1474) |
|---|---|---|---|
| 1 | 8 | 0.50 | 4.00 |
| 2 | 8 | 2.00 | 16.00 |
| 3 | 8 | 5.00 | 40.00 |
| 4 | 8 | 10.00 | 80.00 |
| 5 | 8 | 20.00 | 160.00 |
| 6 | 8 | 20.00 | 160.00 |
| 7 | 9 | 20.00 | 180.00 |
| 8 | 9 | 40.00 | 360.00 |

1475 BILLS ACCEPTOR CONTENTS

| Denom | 1 (1477) | 2 (1477) | Total (1478) | Value (1479) |
|---|---|---|---|---|
| $1 (1476) | 1 | 0 | 1 | $1 |
| $2 (1476) | 0 | 0 | 0 | $0 |
| $5 (1476) | 1 | 0 | 0 | $5 |
| $10 (1476) | 0 | 1 | 1 | $10 |
| $20 (1476) | 0 | 0 | 0 | $0 |
| $50 (1476) | 0 | 0 | 0 | $0 |
| $100 (1476) | 0 | 0 | 0 | $0 |
| Unrecognized (1480) | 0 | 0 | 0 | $0 |
| All (1481) | 2 | 1 | 3 | $16 |

1485 End Current Content Report

*FIG. 15*

1500

1505 Shift Report
1510 Printed at 08-15-2002 14:15
1515 08-14-2002 09:43 AM
to
08-15-2002 14:15 PM
1520 Shift Number 1
1530 08-14-2002 09:43 AM
to
08-14-2002 4:10 PM
1535 ClerkName1

| | | | |
|---|---|---|---|
| 1536 | Tubes Loaded | 1 | 5.00 |
| 1537 | Tubes Vended | 3 | (15.50) |
| 1538 | Empty Vends | 0 | 0.00 |
| 1539 | Bills Fed | 1 | 5.00 |
| 1540 | Vault Drops (cash) | 0 | 0.00 |
| 1541 | Vault Drops (checks) | 1 | 5.00 |
| 1542 | Vault Drops (other) | 0 | 0.00 |
| 1543 | Net | | (0.50) |

1545 TUBES

| Column | 1 | 2 | 3 | 4 | 5 | 6 | 7 | 8 | All |
|---|---|---|---|---|---|---|---|---|---|
| ——— | - | - | - | - | - | - | - | - | -- |
| Vends | 1 | 0 | 1 | 1 | 0 | 0 | 0 | 0 | 3 (1546) |
| Loaded | 0 | 0 | 1 | 0 | 0 | 0 | 0 | 0 | 1 (1547) |

1550 BILLS ACCEPTED

| Denomination (1551) | Count (1552) | Total (1553) |
|---|---|---|
| $1 | 0 | 0.00 |
| $2 | 0 | 0.00 |
| $5 | 1 | 5.00 |
| $10 | 0 | 0.00 |
| $20 | 0 | 0.00 |
| $50 (1554) | 0 | 0.00 |
| $100 | 0 | 0.00 |
| Unrecognized | 0 | |
| All (1555) | 1 | 5.00 |

Note: The same activity information as above will be repeated for each user programmed in the unit.

1575 End Shift Report

*FIG. 16A*

1600

1605 Summary Report
1610 Printed at 08-16-02 08:42
1615 08-15-2002 09:43 to 08-16-2002 08:42
1620 Printed by Name1

| | | | |
|---|---|---|---|
| 1626 | Beginning Tubes | 1000.00 | 1625 |
| 1627 | Beginning Vault Drop | 240.00 | |
| 1628 | Cash Vault Drops | 70.00 | |
| 1629 | Check Vault Drops | 70.00 | |
| 1630 | Other Vault Drops | 100.00 | |
| 1631 | Beginning Vault | 0.00 | |
| 1632 | Beginning Courier Tray | 0.00 | |
| 1633 | Beginning Bill Acceptors | 11.00 | |

NETS

| | | | |
|---|---|---|---|
| 1636 | Net Tubes | 0.00 | 1635 |
| 1637 | Net Vault Drops | 0.00 | |
| 1638 | Net Vault | 0.00 | |
| 1639 | Net Courier Tray | 0.00 | |
| 1640 | Net Bill Acceptors | 5.00 | |

| | DEPOSITS | COUNT | VALUE | |
|---|---|---|---|---|
| 1646 | Tubes Loaded (clerk) | 0 | 0.00 | 1645 |
| 1647 | Tubes Loaded (manager) | 0 | 0.00 | |
| 1648 | Pos Manager Tube Adjusts | 0 | 0.00 | |
| 1649 | Drops made (cash) | 0 | 0.00 | |
| 1650 | Drops made (check) | 0 | 0.00 | |
| 1651 | Drops made (other) | 0 | 0.00 | |
| 1652 | Vault | 0 | 0.00 | |
| 1653 | Courier Drop-offs | 0 | 0.00 | |
| 1654 | Courier Tray | 0 | 0.00 | |
| 1655 | Bill Acceptors | 1 | 5.00 | |

| | WITHDRAWALS | COUNT | VALUE | |
|---|---|---|---|---|
| 1661 | Tubes Vended | 0 | 0.00 | 1660 |
| 1662 | Tubes Dumped | 0 | 0.00 | |
| 1663 | Neg Manager Tube Adjusts | 0 | 0.00 | |
| 1664 | Drop Withdrawals | 0 | 0.00 | |
| 1665 | Vault | 0 | 0.00 | |
| 1666 | Courier Tray | 0 | 0.00 | |
| 1667 | Bill Acceptors | 0 | 0.00 | |

CURRENT TOTALS

| | | | |
|---|---|---|---|
| 1671 | Current Tubes | 1000.00 | 1670 |
| 1672 | Current Drop (Cash) | 70.00 | |
| 1673 | Current Drop (Check) | 70.00 | |
| 1674 | Current Drop (Other) | 100.00 | |
| 1675 | Current Vault | 0.00 | |
| 1676 | Current Courier Tray | 0.00 | |
| 1677 | Current Bill Acceptors | 16.00 | |

*(Summary Report Continued on next page)*

*FIG. 16B*

*(Summary Report Continued)*

1680 COLUMN CONTENTS

| Col Num (1681) | Tube Count (1682) | Tube Value (1683) | Col Total (1684) |
|---|---|---|---|
| 1 | 8 | 0.50 | 4.00 |
| 2 | 8 | 2.00 | 16.00 |
| 3 | 8 | 5.00 | 40.00 |
| 4 | 8 | 10.00 | 80.00 |
| 5 | 8 | 20.00 | 160.00 |
| 6 | 8 | 20.00 | 160.00 |
| 7 | 9 | 20.00 | 180.00 |
| 8 | 9 | 40.00 | 360.00 |

1685 BILLS ACCEPTOR CONTENTS

| Denom (1686) | 1 | 2 (1687) | Total (1688) | Value (1689) |
|---|---|---|---|---|
| $1 | 1 | 0 | 1 | $1 |
| $2 | 0 | 0 | 0 | $0 |
| $5 | 1 | 0 | 0 | $5 |
| $10 | 0 | 1 | 1 | $10 |
| $20 | 0 | 0 | 0 | $0 |
| $50 | 0 | 0 | 0 | $0 |
| $100 (1690) | 0 | 0 | 0 | $0 |
| Unrecognized | 0 | 0 | 0 | $0 |
| All (1691) | 2 | 1 | 3 | $16 |

1692 DOOR OPENS

| | Clerk (1693) | Manager (1694) | Courier (1695) | Unknown (1696) |
|---|---|---|---|---|
| 1697 Main Vault | 0 | 0 | 0 | 0 |
| 1698 Drop Chute | 0 | 0 | 0 | 0 |
| 1699 Bill Acceptor | 0 | 0 | 0 | 0 |
| 1700 Storage Vault | 0 | 0 | 0 | 0 |

1600 1701 COLUMN ACTIVITY

| 1702 Column | 1 | 2 | 3 | 4 | 5 | 6 | 7 | 8 | All (1711) | Val (1712) |
|---|---|---|---|---|---|---|---|---|---|---|
| 1703 Normal Vend | 0 | 0 | 0 | 0 | 0 | 0 | 0 | 0 | 0 | 0.00 |
| 1704 Clerk Load | 0 | 0 | 0 | 0 | 0 | 0 | 0 | 0 | 0 | 0.00 |
| 1705 Mgr Load | 0 | 0 | 0 | 0 | 0 | 0 | 0 | 0 | 0 | 0.00 |
| 1706 Mgr Adjust | 0 | 0 | 0 | 0 | 0 | 0 | 0 | 0 | 0 | 0.00 |
| Dump (1707) | 0 | 0 | 0 | 0 | 0 | 0 | 0 | 0 | 0 | 0.00 |
| 1708 No Vend | 0 | 0 | 0 | 0 | 0 | 0 | 0 | 0 | 0 | 0.00 |
| 1709 Empty Vend | 0 | 0 | 0 | 0 | 0 | 0 | 0 | 0 | 0 | 0.00 |
| 1710 Wrong Vend | 0 | 0 | 0 | 0 | 0 | 0 | 0 | 0 | 0 | 0.00 |

1715 BILLS ACCEPTOR ACTIVITY

| Denom (1716) | 1 | 2 (1719) | Total (1720) |
|---|---|---|---|
| $1 | 0 | 0 | 0 |
| $2 | 0 | 0 | 0 |
| $5 | 1 | 0 | 0 |
| $10 | 0 | 0 | 0 |
| $20 | 0 | 0 | 0 |
| $50 | 0 | 0 | 0 |
| $100 | 0 | 0 | 0 |
| $??? | 0 | 0 | 0 |
| All (1717) | 1 | 0 | 1 |
| Value (1718) | 5.00 | 0.00 | 5.00 |

1721 1722 Name1

| | | (1729) | (1730) |
|---|---|---|---|
| 1723 Bills Accepted | | 1 | 5.00 |
| Cash Drops (1724) | | 0 | 0 |
| 1725 Check Drops | | 0 | 0 |
| Other Drops (1726) | | 0 | 0 |
| 1727 Tubes Vended | | 0 | 0 |
| Tubes Loaded (1728) | | 0 | 0 |

1740 End of Summary Report

*FIG. 17*

1800

1801 Setup
08-15-02 10:57
CE Version 4.00 build 708
Sentinel version: X.XX
Motovend controller COM 1 version: 010M
Datakey Reader version: 1.0
MEI compatible acceptor on COM 5 version: 42, Model 1
MEI compatible acceptor on COM 6 version: 42, Model 1
Seiko 3445 printer on COM 3 version: Unknown
Debug printer version: n/a

1805

1810

| 1811 COL NUM | 1812 DENOM NATION | 1813 IN TUBE | 1814 TUBE VALUE |
|---|---|---|---|
| 1 | 0.01 | 50 | 0.50 |
| 2 | 0.05 | 40 | 2.00 |
| 3 | 0.10 | 50 | 5.00 |
| 4 | 0.25 | 40 | 10.00 |
| 5 | 1.00 | 10 | 10.00 |
| 6 | 5.00 | 4 | 20.00 |
| 7 | 10.00 | 2 | 20.00 |
| 8 | 20.00 | 2 | 40.00 |

1815

1817 COURIER_SUBJECT_TO_LOCKOUT FALSE 1816
DOOR_DELAY_0000600
1818 WEEKLY_LOCK_ENABLED FALSE
DAILY_LOCK_ENABLED FALSE 1819
1820 DAILY LOCK 11 30 01 00
PROGRAMMABLE_VEND_ENABLED FALSE 1821
1822 ALT_VEND FALSE 000030
ALT_DOOR_ENABLED FALSE 1823
1824 ALT_DOOR_DELAY 240
STAM_PORT 00 1826

1825

1827
BILL_READER_CONFIG 00 00 00 MEI COM5 0127
BILL_READER_CONFIG 01 00 00 MEI COM5 0127
BILL_READER_CONFIG 02 00 00 MEI NONE 0000
BILL_READER_CONFIG 03 00 00 MEI NONE 0000
BILL_READER_CONFIG 04 00 00 MEI NONE 0000
BILL_READER_CONFIG 05 00 00 MEI NONE 0000
BILL_READER_CONFIG 06 00 00 MEI NONE 0000
BILL_READER_CONFIG 07 00 00 MEI NONE 0000
1828 SINGLE_USER_MODE FALSE
IBUTTON_PORT 00 1829
1830 MOTOSLAVE_PORT 01
DEBUG PORT 07 1831
1832 LOGGER_ENABLED TRUE
MAIN_VAULT MANAGER_DOOR 1836

1835

1837 READER_VAULT MANAGER_DOOR INSTANT_DOOR
SECONDARY_VAULT MANAGER_DOOR INSTANT_DOOR 1838

1840

1841 PRINTER SEIKO 3
DROP_RECEIPT 2 1842
1843 COURIER_RECEIPT 2
ACCEPTOR_RECEIPT 1 1844
1845 VAULT_TERM Vault
LOTTERY_PORT 0 1851

1850

1852 STORE_IDENTIFIER NAME
SHIFT INACTIVE 4 1853
1854 ACCEPTOR_SEAL FALSE
PIN_LOCKOUT FALSE 1855
1856 DVR_ENABLED FALSE
ACCEPTOR_ESCROW_FALSE 1857

1860 End Setup

FIG. 18

1900

1901 Manager Report, version 1.18.01D 1904
1902 For Store: OFFICE
1903 Printed on 7/15/2004 9:44 AM 1905 MARY
1910 Pin - 5555
1915 Vend limit $200.00
1917 Can print reports
1918 Can load tubes
1919 Can end business day
1920 Can end shift
1921 Language English (United States)
1922 Can open storage door
1923 Can change own PIN
1924 Can open main vault door
1925 Can open acceptor door
1926 Can activate alternate vend interval
1927 Can activate time of day vend interval
1928 Can activate time of day or week lockout
1929 Can dump tubes
1930 Can adjust tube counts
1931 Can move vault contents
1932 Can adjust vault drops
1933 Can adjust reserve (main vault)
1934 Can adjust courier tray
1935 Can edit, add, and delete clerk accounts
1936 Can NOT edit, add, and delete managers
1937 Can clear acceptor counts
1938 Can NOT configure columns

1916

1939 End of Manager Report

FIG. 19

2000

2001 Clerk Report, version 1.18.01D 2004
2002 For Store: OFFICE
2003 Printed on 7/15/2004 9:43 AM 2005 ANNE
2010 PIN - 1111
2015 Vend limit $40.00
2017 Can print reports
2018 Can load tubes
2019 Can NOT end business day
2020 Can NOT end shift
2021 Language English (United States)
2022 Can NOT open storage door
2023 Can change own PIN

2016

2024 End of Clerk Report

FIG. 20

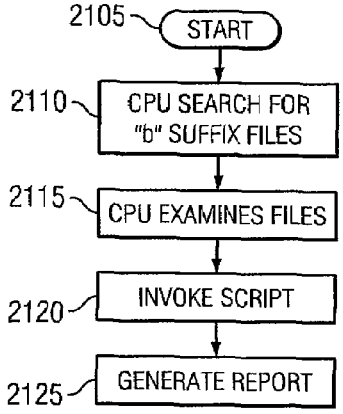

*FIG. 21*

#SCRIPT_NAME_Scripted End of Day 2205
#REPORT_TYPE END_OF_DAY 2210
#INTERVAL BY_BUSINESS_DAY_WITH_SHIFTS 2215
#FAMILY KASPAR 2220

*FIG. 22*

#SCRIPT_NAME Reprint End of Shift 2305
#REPORT_TYPE SCREEN 2306
#INTERVAL BY_BUSINESS_DAY_WITH_SHIFTS 2307
#FAMILY ORIGINAL 2308
#CLERK_PRINT 2309
#BY_USER 2310

*FIG. 23*

2300

2301 Courier Pickup, version 1.18.01D
2302 For Store: OFFICE
2304 Printed on 7/16/2004 2:02 PM MARY 2305
2306 3/21/2004 10:24 AM
to
3/25/2004 11:50 AM
2310 Total value of pickup $7231.28
2315 There should be cash in the courier tray totaling $101.00
2317 There should be check(s) in the courier tray totaling $187.28

2320 BILLS ACCEPTOR COUNTS 2321 2335 2336

| Denomination | 1 | 2 | Total | Value |
|---|---|---|---|---|
| $1 | 174 | 94 | 268 | 268 |
| $2 | 0 | 0 | 0 | 0 |
| $5 | 36 | 29 | 65 | 325 |
| $10 | 8 | 6 | 14 | 140 |
| $20 | 123 | 85 | 208 | 4160 |
| $50 | 3 | 4 | 7 | 350 |
| $100 | 11 | 6 | 17 | 1700 |
| Unrecognized | 0 | 0 | 0 | |
| All | 2322 355 | 224 2322 | 579 2337 | 6943 2338 |
| Value | 2333 4144 | 2799 2333 | 6943 2338 | |

2340

Breakdown by business day
2341 Partial day ending 3/22/2004 8:00 AM
2342 Acceptor cash: $1379.00
Courier tray cash deposits: 2343 $1.00
2344 Courier tray check deposits: $41.95
Total deposit value: 2345 $1421.95
2346 Business day ending 3/22/2004 10:15 PM
2347 Acceptor cash: $1849.00
Courier tray cash deposits: 2348 $0.00
2349 Courier tray check deposits: $0.00
Total deposit value: 2350 $1849.00
2351 Business day ending 3/23/2004 5:33 AM
Acceptor cash: $0.00
Courier tray cash deposits: $0.00
Courier tray check deposits: $0.00
Total deposit value: $0.00
2352 Business day ending 3/23/2004 10:20 PM
Acceptor cash: $1619.00
Courier tray cash deposits: $0.00
Courier tray check deposits: $37.01
Total deposit value: $1656.01
2353 Business day ending 3/25/2004 5:34 AM
Acceptor cash: $1561.00
Courier tray cash deposits: $100.00
Courier tray check deposits: $100.00
Total deposit value: $1761.00
2354 Partial day up to 3/25/2004 11:50 AM
Acceptor cash: $535.00
Courier tray cash deposits: $0.00
Courier tray check deposits: $8.32
Total deposit value: $543.32
2355 End of Courier Pickup

*FIG. 24*

2400

2401 Current Content Report, version 1.18.01D
2402 For Store: OFFICE
2403 Printed on 7/16/2004 2:02 PM MARY 2404

2405 Current Vault Drop

| | | |
|---|---|---|
| 2406 | (Cash) | 0.00 |
| 2407 | (Check) | 0.00 |
| 2408 | (Total) | 0.00 |

2409 Current Reserve Change Fund

| | | |
|---|---|---|
| 2410 | (Cash) | 1616.00 |
| 2411 | (Check) | 0.00 |
| 2412 | (Total) | 1616.00 |

2413 Current Courier Tray

| | | |
|---|---|---|
| 2414 | (Cash) | 0.00 |
| 2415 | (Check) | 0.00 |
| 2416 | (Total) | 0.00 |

2420 COLUMN CONTENTS

| Col Num | Tube Count (2421, 2422) | Tube Value (2423) | Col Total (2424) |
|---|---|---|---|
| 1 | 0 | 2.00 | 0.00 |
| 2 | 0 | 5.00 | 0.00 |
| 3 | 0 | 10.00 | 0.00 |
| 4 | 0 | 10.00 | 0.00 |
| 5 | 0 | 15.00 | 0.00 |
| 6 | 0 | 40.00 | 0.00 |
| 7 | 0 | 40.00 | 0.00 |
| 8 | 0 | 40.00 | 0.00 |
| Total | 0 | | 0.00 2425 |

2430 BILLS ACCEPTOR CONTENTS

| Denomination | 1 (2431) | 2 (2432) | Total (2433) | Value (2434) |
|---|---|---|---|---|
| $1 | 52 | 43 | 95 | 95 |
| $2 | 0 | 0 | 0 | 0 |
| $5 | 0 | 0 | 0 | 0 |
| $10 | 0 | 0 | 0 | 0 |
| $20 | 16 | 33 | 49 | 980 |
| $50 | 0 | 0 | 0 | 0 |
| $100 2439 | 1 | 0 | 1 | 100 |
| Unrecognized | 0 | 0 | 0 | |
| All | 2435 69 | 2435 76 | 145 2437 | 1175 2438 |
| Value | 2436 472 | 2436 703 | 1175 2438 | |

2440 End of Current Content Report

*FIG. 25A*

2501 Shift Report, version 1.18.01D 2505
2502 For Store: OFFICE
2503 Printed on 7/16/2004 2:03 PM MARY 2506
2504 3/28/2004 5:25 AM
to
3/29/2004 5:39 AM
2507 Shift Number: 1
2508 3/28/2004 5:25 AM
to
3/28/2004 1:46 PM
2509 BEN
2510 Tubes loaded 20 306.00
2511 Tubes vended 13 ( 136.00)
2512 Bills accepted 39 480.00
2513 No vault drops were made
2514 Drop withdrawals, adj ( 32.60)
2515 Reserve withdrawals, adj ( 246.00)
2516 Courier tray deposits, adj ( 32.60)

2517 TUBES

| Column | 1 | 2 | 3 | 4 | 5 | 6 | 7 | 8 | All | Value |
|---|---|---|---|---|---|---|---|---|---|---|
| --- | - | - | - | - | - | - | - | - | --- | --- |
| Vends | 0 | 3 | 2 | 1 | 0 | 3 | 2 | 2 | 13 | 136.00 2518 |
| Mgr Loads | 3 | 3 | 2 | 2 | 1 | 4 | 3 | 2 | 20 | 306.00 2519 |

2520 BILLS ACCEPTED

| Denomination (2521) | Count (2522) | Value (2523) |
|---|---|---|
| $1 | 20 | 20 |
| $20 | 18 | 360 |
| $100 | 1 | 100 |
| Unrecognized 2524 | 0 | |
| All 2525 | 39 | 480 2526 |

2530 COURIER
2531 Tubes loaded 0 0.00
2532 Tubes Vended 0 ( 0.00)
2533 Bills accepted 0 0.00
2534 No vault drops were made
2535 Courier tray withdraw, adj ( 121.17)
2536 TUBES
No activity
2537 BILLS ACCEPTED
No activity
2540 ELAINE
Tubes loaded 2 50.00
Tubes Vended 6 ( 110.00)

TO FIG. 25B

FIG. 25B

FROM FIG. 25A

Bills accepted 13 290.00
No vault drops were made

2540

TUBES

| Column | 1 | 2 | 3 | 4 | 5 | 6 | 7 | 8 | All | Value |
|---|---|---|---|---|---|---|---|---|---|---|
| Vends | 1 | 0 | 0 | 1 | 0 | 2 | 0 | 2 | 6 | 110.00 |
| Mgr Loads | 1 | 0 | 0 | 0 | 0 | 1 | 0 | 0 | 2 | 50.00 |

BILLS ACCEPTED

| Denomination | Count | Value |
|---|---|---|
| $20 | 12 | 240 |
| $50 | 1 | 50 |
| Unrecognized | 0 | |
| All | 13 | 290 |

2541 Total dep. for shift # 1 770.00
2542 Bills accepted 52 770.00
2543 No vault drops were made Shift Number: 2
3/28/2004 1:46 PM
to
3/29/2004 5:39 AM

2545

BEN
Tubes loaded 0 0.00
Tubes vended 0 ( 0.00)

Bills accepted 1 20.00
No vault drops were made

TUBES
No activity

BILLS ACCEPTED

| Denomination | Count | Value |
|---|---|---|
| $20 | 1 | 20 |
| Unrecognized | 0 | |
| All | 1 | 20 |

2550

ELAINE
Tubes loaded 0 0.00
Tubes vended 0 ( 0.00)

Bills accepted 1 20.00
No vault drops were made

TUBES
No activity

BILLS ACCEPTED

| Denomination | Count | Value |
|---|---|---|
| $20 | 1 | 20 |
| Unrecognized | 0 | |
| All | 1 | 20 |

TO FIG. 25C

*FIG. 25C*

FROM FIG. 25B

2500

2555

LES

| | | |
|---|---|---|
| Tubes loaded | 0 | 0.00 |
| Tubes vended | 0 | ( 0.00) |
| Bills accepted | 61 | 555.00 |

No vault drops were made

TUBES

No activity

BILLS ACCEPTED

| Denomination | Count | Value |
|---|---|---|
| $1 | 35 | 35 |
| $20 | 26 | 520 |
| Unrecognized | 0 | |
| All | 61 | 555 |

2556

| | | |
|---|---|---|
| Total dep. for shift # | 2 | 595.00 |
| Bills accepted | 63 | 595.00 |

No vault drops were made

2560

| | | | |
|---|---|---|---|
| Total dep. for all shifts | | 1365.00 | 2561 |
| Bills accepted | 115 | 1365.00 | 2562 |

No vault drops were made 2563

2565 End of Shift Report

*FIG. 26A*

2600

2601 Summary Report, version 1.18.01D 2605

2602 For Store: OFFICE

2603 Printed on 7/16/2004 2:03 PM MARY 2604

2606 3/28/2004 5:25 AM
to
3/29/2004 5:39 AM

| | | | |
|---|---|---|---|
| 2611 | Beginning Tubes | 1122.00 | 2610 |
| 2612 | Beginning Main Vault | 2047.00 | |
| | Cash | 2047.00 | |
| 2613 | Beginning Vault Drop | 32.60 | |
| | Check | 32.60 | |
| 2614 | Beginning Courier Tray | 88.57 | |
| | Check | 87.58 | |
| | Other | 0.99 | |
| 2615 | Beginning Bill Acceptors | 4858.00 | |

NETS

| | | | |
|---|---|---|---|
| 2621 | Net Tubes | 110.00 | 2620 |
| 2622 | Net Tube Adjust | 0.00 | |
| 2623 | Net Vault Drops | ( -32.60) | |
| 2624 | Net Main Vault | ( -246.00) | |
| 2625 | Net Courier Tray | ( -88.57) | |
| 2626 | Net Bill Acceptors | ( -3843.00) | |

TO FIG. 26B

FIG. 26B

FROM FIG. 26A

2600

| | DEPOSITS | COUNT | VALUE | |
|---|---|---|---|---|
| 2631 | Tubes Loaded (clerk) | 0 | 0.00 | 2630 |
| 2632 | Tubes Loaded (manager) | 22 | 356.00 | |
| 2633 | Pos Manager Tube Adjusts | 0 | 0.00 | |
| 2634 | Vend Failure Credits | 0 | 0.00 | |
| 2635 | Vault Drops (cash) | 0 | 0.00 | |
| 2636 | Vault Drops (check) | 0 | 0.00 | |
| 2637 | Vault Drops (other) | 0 | 0.00 | |
| 2638 | Main Vault | 0 | 0.00 | |
| 2639 | Courier Tray | 1 | 32.60 | |
| 2640 | Bill Acceptors | 115 | 1365.00 | |

| | WITHDRAWALS | COUNT | VALUE | |
|---|---|---|---|---|
| 2641 | Tubes Vended | 19 | ( 246.00) | 2645 |
| 2642 | Tubes Dumped | 0 | ( 0.00) | |
| 2643 | Neg Manager Tube Adjusts | 0 | ( 0.00) | |
| 2644 | Vault Drop Withdrawals | 1 | ( 32.60) | |
| 2646 | Main Vault | 1 | ( 246.00) | |
| 2647 | Courier Tray | 2 | ( 121.17) | |
| 2648 | Bill Acceptors | | ( 5208.00) | |

COLUMN ACTIVITY

| | Column | 1 | 2 | 3 | 4 | 5 | 6 | 7 | 8 | All | Value | |
|---|---|---|---|---|---|---|---|---|---|---|---|---|
| 2651 | Vends | 1 | 3 | 2 | 2 | 0 | 5 | 2 | 4 | 19 | 246.00 | 2650 |
| 2652 | Failures | 0 | 0 | 0 | 0 | 0 | 0 | 0 | 0 | 0 | 0.00 | |
| 2653 | Clerk Loads | 0 | 0 | 0 | 0 | 0 | 0 | 0 | 0 | 0 | 0.00 | |
| 2654 | Mgr Loads | 4 | 3 | 2 | 2 | 1 | 5 | 3 | 2 | 22 | 356.00 | |
| 2655 | Dumps | 0 | 0 | 0 | 0 | 0 | 0 | 0 | 0 | 0 | 0.00 | |
| 2656 | + Adjusts | 0 | 0 | 0 | 0 | 0 | 0 | 0 | 0 | 0 | 0.00 | |
| 2657 | - Adjusts | 0 | 0 | 0 | 0 | 0 | 0 | 0 | 0 | 0 | 0.00 | |
| 2658 | No Vends | 0 | 0 | 0 | 0 | 0 | 0 | 0 | 0 | 0 | 0.00 | |
| 2659 | Empty Vends | 0 | 0 | 0 | 0 | 0 | 0 | 0 | 0 | 0 | 0.00 | |
| 2660 | Wrong Vends | 0 | 0 | 0 | 0 | 0 | 0 | 0 | 0 | 0 | 0.00 | |

BILL ACCEPTOR ACTIVITY

| | Denomination | 1 | 2 | Total | Value | |
|---|---|---|---|---|---|---|
| 2661 | $1 | 31 | 24 | 55 | 55 | 2665 |
| 2662 | $2 | 0 | 0 | 0 | 0 | |
| 2663 | $5 | 0 | 0 | 0 | 0 | |
| 2664 | $10 | 0 | 0 | 0 | 0 | |
| 2666 | $20 | 19 | 39 | 58 | 1160 | |
| 2667 | $50 | 1 | 0 | 1 | 50 | |
| 2668 | $100 | 1 | 0 | 1 | 100 | |
| 2669 | Unrecognized | 0 | 0 | 0 | | |
| 2670 | All | 52 | 63 | 115 | 1365 | |
| 2671 | Value | 561 | 804 | 1365 | | |

TO FIG. 26C

FIG. 26C

FROM FIG. 26B

2600

| | | | | |
|---|---|---|---|---|
| | BEN | | | |
| 2676 | Bills accepted | 40 | 500.00 | 2675 |
| 2677 | Tubes vended | 13 | 136.00 | |
| 2678 | Tubes loaded | 20 | 306.00 | |
| | ELAINE | | | |
| 2681 | Bills accepted | 14 | 310.00 | 2680 |
| 2682 | Tubes vended | 6 | 110.00 | |
| 2683 | Tubes loaded | 2 | 50.00 | |
| | LES | | | |
| 2691 | Bills accepted | 61 | 555.00 | 2690 |
| 2692 | Tubes vended | 0 | 0.00 | |
| 2693 | Tubes loaded | 0 | 0.00 | |
| 2695 | End of Summary Report | | | |

2700

*FIG. 27*

2701 End of Day, version 1.18.01D 2705
2702 For Store: OFFICE
2703 Printed on 7/16/2004 2:02 PM MARY 2706
2704 3/28/2004 5:25 AM
to
3/29/2004 5:39 AM

| | | |
|---|---|---|
| 2707 | Bills Accepted: | 1365.00 |
| 2708 | Total Vault Drops: | 0.00 |
| 2709 | Total Bills + Drops | 1365.00 |
| 2710 | Courier Tray Deposits | |
| 2711 | Total Value: | 32.60 |
| 2712 | Cash: | 0.00 |
| 2713 | Check: | 32.60 |
| 2715 | Shift 1 | |
| 2716 | Bills Accepted: | 770.00 |
| 2717 | Total Vault Drops: | 0.00 |
| 2718 | Total Bills + Drops | 770.00 |
| 2720 | Shift 2 | |
| 2721 | Bills Accepted: | 595.00 |
| 2722 | Total Vault Drops: | 0.00 |
| 2723 | Total Bills + Drops | 595.00 |

2724 End of End of Day

*FIG. 28A*

2800

2801 End of Shift, version 1.18.01D 2805
2802 For Store: OFFICE
2803 Printed on 7/16/2004 2:03 PM MARY 2806
2804 3/28/2004 5:25 AM
to
3/28/2004 1:46 PM
2807 Shift Number: 1
2808 3/28/2004 5:25 AM
to
3/28/2004 1:46 PM
2810 BEN

| | | | |
|---|---|---|---|
| 2811 | Tubes loaded | 20 | 306.00 |
| 2812 | Tubes vended | 13 | ( 136.00) |
| 2813 | Bills accepted | 39 | 480.00 |
| 2814 | No vault drops were made | | |
| 2815 | Drop withdrawals, adj | | ( 32.60) |
| 2816 | Reserve withdrawals, adj | | ( 246.00) |
| 2817 | Courier tray deposits, adj | | 32.60 |

2819 TUBES

| Column | 1 | 2 | 3 | 4 | 5 | 6 | 7 | 8 | All | Value |
|---|---|---|---|---|---|---|---|---|---|---|
| --- | - | - | - | - | - | - | - | - | --- | --- |
| Vends | 0 | 3 | 2 | 1 | 0 | 3 | 2 | 2 | 13 | 136.00 2820 |
| Mgr Loads | 3 | 3 | 2 | 2 | 1 | 4 | 3 | 2 | 20 | 306.00 2821 |

2822 BILLS ACCEPTED (2823)

| Denomination | Count (2824) | Value (2825) |
|---|---|---|
| $1 | 20 | 20 |
| $20 | 18 | 360 |
| $100 | 1 | 100 |
| Unrecognized 2827 | 0 | |
| All 2828 | 39 | 480 2826 |

2830 COURIER

| | | | |
|---|---|---|---|
| 2831 | Tubes loaded | 0 | 0.00 |
| 2832 | Tubes vended | 0 | ( 0.00) |
| 2833 | Bills accepted | 0 | 0.00 |
| 2834 | No vault drops were made | | |
| 2835 | Courier tray withdraw, adj | | ( 121.17) |

TUBES
2836 No activity
BILLS ACCEPTED
2837 No activity

TO FIG. 28B

2800

FROM FIG. 28A

2840

ELAINE

| | | |
|---|---|---|
| Tubes loaded | 2 | 50.00 |
| Tubes vended | 6 | ( 110.00) |
| Bills accepted | 13 | 290.00 |

No vault drops were made

TUBES

| Column | 1 | 2 | 3 | 4 | 5 | 6 | 7 | 8 | All | Value |
|---|---|---|---|---|---|---|---|---|---|---|
| Vends | 1 | 0 | 0 | 1 | 0 | 2 | 0 | 2 | 6 | 110.00 |
| Mgr Loads | 1 | 0 | 0 | 0 | 0 | 1 | 0 | 0 | 2 | 50.00 |

BILLS ACCEPTED

| Denomination | Count | Value |
|---|---|---|
| $20 | 12 | 240 |
| $50 | 1 | 50 |
| Unrecognized | 0 | |
| All | 13 | 290 |

2841 Total dep. for shift # 1 770.00

2842 Bills accepted 52 770.00

2843 No vault drops were made

2844 End of End of Shift

*FIG. 28B*

COMPUTERIZED DROP SAFE AND CONTROL SOFTWARE

RELATED APPLICATION DATA

This application is a Divisional application of application Ser. No. 10/896,414, filed Jul. 22, 2004 which is related to Provisional Patent Application Ser. No. 60/489,802 filed on Jul. 24, 2003 and Provisional Patent Application Ser. No. 60/528,360 filed on Dec. 10, 2003, in the United States Patent and Trademark Office, and priority is claimed for these two earlier filings under 35 U.S.C. § 120. The Provisional Patent Applications are also incorporated by reference into this patent application.

TECHNICAL FIELD OF THE INVENTION

A computerized drop safe and associated control software.

BACKGROUND OF THE INVENTION

Numerous retail businesses operate under conditions leading to a high probability of robbery, embezzlement, or mishandling of funds. Most revenue in many small retail sales is in the form of cash receipts. Many small retail operations, such as 24-hour convenience stores, fast food establishments, gas stations, diners, and liquor stores are targets of armed robberies on a frequent basis. Many criminals view these types of retail stores as repositories of several hundreds to thousands of dollars in small denomination bills (e.g. $20 and less) that are not tracked by serial number by the businesses and remain impossible to trace. During normal hours of operation, these businesses can receive hundreds, and even thousands, of dollars in cash receipts.

In addition to armed robberies, burglaries, and the like, these small businesses face other difficulty in fully controlling cash receipts. Typically, armored-car pickups will collect currency and transport the currency to a central location for counting and deposit into a bank account. Employees of these armored-car operations have been known to pilfer these cash receipts. Mismatches between cash receipt records and actual cash deposited are more often than not dismissed as honest accounting errors or actual embezzlement and theft by store employees.

For many retail operations, cash thefts by employees are an accepted reality. In many instances, these store positions for cashiers are often transient; filled by individuals that are working part-time or gaining experience for better paying jobs at some future date. Less frequently, an employee goes to work at a convenience store for a limited time to steal from the employer and depart before their dishonesty becomes apparent. Less often, but still with distressing frequency, store managers embezzle funds or manipulate accounting procedures to cover discrepancies.

As a deterrent to losses from dishonest employees, and more importantly to reduce the perception of easy cash for armed robbers, many retail operations have implemented policies that reduce the amount of accessible, ready cash on a business premise. At the end of their shifts, cashiers close out their registers and transfer their receipts (both currency and check) to a secured storage location on the store premises. Usually these deposits are in sealed envelopes and identify the employee and/or identify the cash register. Many retail operations additionally require cashiers to periodically remove currency from their registers and deposit it into the secure location as a further means of reducing cash accumulation that can be stolen by robbers. The secure location is very often a restricted access safe. Restricted access safes that employees do not have access to that employees routinely deposit cash receipts into are now found in most retail operations.

Drop safes have been developed to address many of the security issues confronted by small businesses. In concept, a drop safe provides a receptacle that a cashier can "drop" receipts into a secure compartment, usually in an envelope with the identity of the employee and the amount of the currency and checks contained in the envelope. Typically, employees in the store do not have access to the drop safe, either because of no key, no knowledge of the combination or access code, or a time lock feature that permits entry only at designated times.

These drop safe designs have become increasingly sophisticated over the years, evolving from relatively simple metal boxes with a single drop slot and/or compartment for deposits into computerized, multi-compartment safes with currency vending options and currency denomination-sensitive receptacles to receive currency. While computerized drop safes have improved control over store receipts, current computerized drop safe designs and software applications have not provided a completely satisfactory solution. By and large, the cash remains vulnerable to opportunist employees who can often pilfer cash when receipts are removed from the safe, who can manipulate the receipt records to embezzle cash, or third party employees (banks, armored-car companies, etc) that have access to the cash and an ability to manipulate the receipt records and/or accounting.

A drop safe incorporating computers operating security and accounting/bookkeeping applications can provide access control and currency and receipt tallying and tracking functions. The development of these currency and information tracking abilities provides a capability for businesses to implement an accounting and security protocol that includes different accounting options for currency and receipt tracking, accounting, data management, and historical reports. However, individual customers usually desire individualized report formats that can vary greatly. For currently implemented and available accounting applications, these report formats must be individually tailored and programmed into the drop safe program's software code by the safe manufacturer or a software developer. The applications must be rewritten to accommodate the customized report format and are not readily modified should new reports be desired and requested.

There is a need for an improved computerized drop safe incorporating a point-of-sale accounting system and software application that permits user-modified reports, accounting, and security access protocols that deter both robbery and employee theft and embezzlement by providing automated currency tracking and accounting that is resistant to manipulation and alteration. Such a drop safe should also offer superior efficiencies by permitting real time monitoring by management of receipt deposits, currency vends, receipt records, security monitoring (e.g. individuals accessing safe and individuals making deposits), generation of reports upon demand, or automated generation of reports either locally at the store or at another location by business managers.

SUMMARY OF THE INVENTION

The invention is a computerized drop safe with an integrated computer central processing unit (CPU) that acts as a robbery deterrent and provides or integrates with a store's Point-of-Sales (POS) and accounting systems to reduce internal theft. The control software is designed and optimized for multi-location retailers to provide a remote, centralized monitoring and control option and/or a back-office monitoring and control option for in-store managers, but it can be operated as a stand alone safe at a single location retailer.

The computerized drop safe possesses an Ethernet connection for a local area network (LAN) which provides an interface to a Point-of-Sale System (POS) and/or a modem interface to support centralized management and monitoring. The drop safe can also link to a printer to print out reports locally at the retail business location. A bill acceptor is also integrated into the safe for depositing paper currency, and this bill acceptor includes a sensor, or validator, that detects counterfeits and the denomination of the currency deposited. This acceptor can also act as a currency recycler that allows store employees to withdraw currency as required. Transactions are logged into a memory that includes the user account making the transaction.

The software program operating on the CPU includes a script computer program for "scripting" reports to print out either as an integrated portion of an accounting and/or security computer program or as a separate module. A "script" is a simple program that the computer executes by interpreting the text source file. Script languages are designed for non-professional individuals to build small, casual programs. People without any advanced programming skills can easily learn a script language and write their own applications. After receipt of the safe, customers can configure the computer program to design and generate desired report formats without a need for someone possessing computer language and developer skills to modify the computer software. These generated reports include transaction data recorded in the memory.

BRIEF DESCRIPTION OF THE DRAWINGS

The objects and features of the invention will become more readily understood from the following detailed description and appended claims when read in conjunction with the accompanying drawings in which like numerals represent like elements and in which:

FIG. 1 shows the basic external structure of a computerized drop safe in the invention;

FIG. 3 shows the basic communication interfaces to the CPU;

FIG. 9 is an example of a Total Drop Report;

FIG. 10 is an example of a Transaction Report;

FIG. 11 is an example of a Courier Deposit Report;

FIG. 12 is an example of a Courier Withdrawal Report;

FIG. 13 is an example of a Courier Content Report;

FIG. 14 is an example of a Current Content Report;

FIG. 15 is an example of a Shift Report;

FIGS. 16A and 16B are an example of a Summary Report;

FIG. 17 is an example of a Setup Report;

FIG. 18 is an example of a Manager Description Report;

FIG. 19 is an example of a Clerk Description Report;

FIG. 20 is a flow diagram showing the report script subprogram's operation;

FIG. 21 shows a first example of the header used in the report script subprogram;

FIG. 22 shows a second example of the header used in the report script subprogram;

FIG. 23 shows an example of a Courier Pickup Report generated with the report script subprogram;

FIG. 24 shows an example of a Current Content Report generated with the report script subprogram;

FIGS. 25A, 25B and 25C show an example of a Shift Report generated with the report script subprogram;

FIGS. 26A, 26B and 26C show an example of a Summary Report generated with the report script subprogram;

FIG. 27 shows an example of an End of Day Report generated with the report script subprogram; and FIGS. 28A and 28B show an example of an End of Shift Report generated with the report script subprogram.

DETAILED DESCRIPTION OF THE PREFERRED EMBODIMENTS

The Hardware Features

Figure 2:
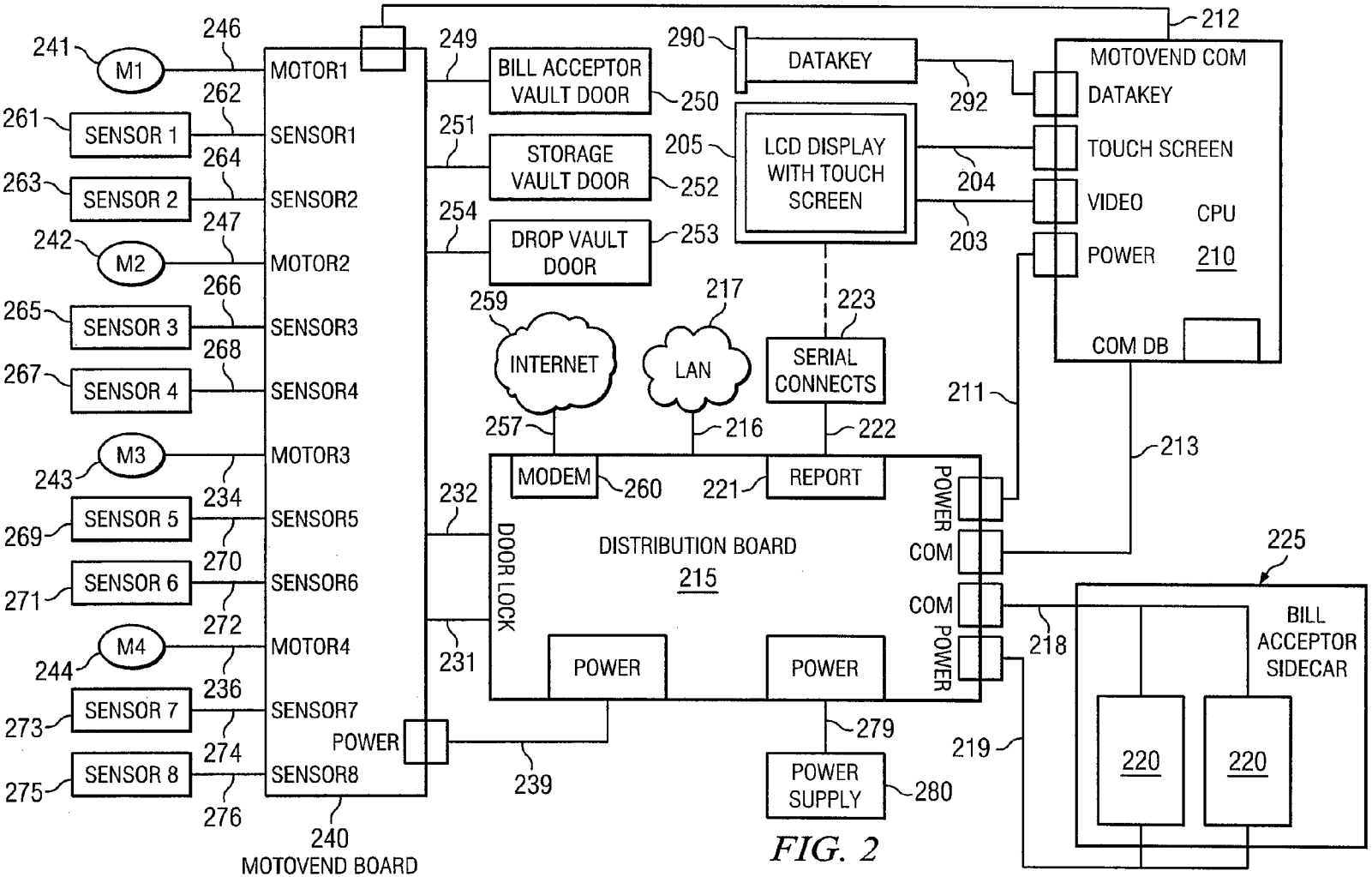
FIG. 2 shows the basic electronic connections between the major structural elements of the safe.

Referring to FIG. 1, the external features of the computerized drop safe 5 include eight coin tube deposit slots 10 for depositing rolls, or tubes, of quarters, dimes, nickels, and pennies. A tube may also contain paper currency for depositing using the tube, and these tubes or rolls are stored in vertical columns in a motovend inside the safe that dispenses, or vends, tubes stored in the motovend to a drop pan 50. The drop pan 50 is sound deadened to limit awareness of currency dispensing to people in the store when tubes are dispensed.

A touch sensitive liquid crystal display (LCD) 20 is used to display information and input commands into a central processing unit (CPU). There are three vault doors (30, 35, and 40) on the computerized drop safe, and access to each vault door is controlled by the CPU's computer program security protocols using solenoids in the door lock assemblies. Vault door 40 secures the drop vault which includes a deposit slot 31 where envelopes containing currency and checks or tubes of coins or currency can be deposited. Vault door 35 secures a storage or courier vault that does not have a drop slot and is generally used to segregate reserve cash for replenishing the cash register or store receipts for courier pickup.

Vault door 30 secures the bill acceptor and currency recycling equipment including cassettes for storing the cash currency. Two bill acceptors 45 are included inside this vault, and paper currency fed into the bill acceptors 45 are deposited into the cassette located inside the vault. The bill acceptors 45 include a denomination sensor, or validator, enabling the CPU to monitor the amount of currency deposited into the cassette. This can include a cash recycling function that can both dispense and receive cash.

FIG. 2 shows the basic electrical connections or interfaces of the computerized drop safe components. The touch sensitive LCD 205 interfaces with the CPU 210 for user inputs to operate the computerized drop safe, access reports, and provide instructions to the CPU 210 using a touch sensitive data input 203 and a video signal output to the LCD 204. The CPU 210 interfaces with a distribution board 215 using communication interface 213. The distribution board 215 includes an Ethernet connection 216 to a local area network (LAN) 217, an RS-485 port 221 for connecting to additional sidecars (e.g. bill acceptors), and/or multiple serial connections 223 using communication link 222. The distribution board 215 also possesses a modem 260 that can interface with the Internet 259 or provide a point-to-point dial up communication option using communication link 257. The distribution board 215 also interfaces with the bill acceptors 220 to supply a communication link 218 and a power link 219 to a pair of bill acceptors/validators 220 that reside inside the bill acceptor sidecar 225. Power is also provided from the distribution board 215 over electrical connection 211 to the CPU 210. Main power 280 is provided to the distribution board 215 using electrical connection 279 for distribution to the other components.

The bill acceptors/validators 220 interface with the CPU 210 to monitor currency deposited and update accounting information used by the CPU 210 in the computer program. The distribution board 215 also interfaces with a motovend 240 to provide power over electrical connection 239. A motovend communication link 212 connects the motovend 240 to the CPU 210 to control tube vending and access to tube storage columns. A connection 231 from the motovend 240 to the distribution board 215 controls the electronic lock in bill acceptor vault door 250 using communication connection 232 to communication connection 249 to unlock the vault door for access to that portion of the safe using the LCD/CPU interface by controlling the electronic lock so that cash cassettes containing deposited cash can be removed. Likewise, a connection 231 from the motovend board 240 to the distribution board 215 connects to the storage vault door 252 using communication link 232 to communication link 251 to control access to that portion of the safe using the LCD/CPU interface to control an electronic lock in the door assembly. Similarly, the distribution board 215 and the motovend board 240 is also connected to the drop safe vault door using communication link 232 to communication link 254 to control access to that portion of the safe using the LCD/CPU interface to control an electronic lock in the door assembly. The LCD/CPU interface also uses the communication link 212 to the motovend board 240 to control coin tube deposits and vends. The distribution board 215 also supplies power to the motovend board 240 using power connection 239.

The motovend board 240 vends and accepts deposits by controlling four motors that connect to the motovend board 240. Motor 1 244 connects to the motovend board 215 by electrical connection 236, motor 2 242 connects to the motovend board 215 by electrical connection 247, motor 3 243 connects to the motovend board 215 by electrical connection 234, and motor 4 244 connects to the motovend board 215 by electrical connection 236. Sensors also connect to the motovend board 215 to provide data inputs to the CPU 210. Sensor 1 261 is connected to the motovend board 215 by communication connection 261, sensor 2 263 is connected to the motovend board 215 by communication connection 264, sensor 3 265 is connected to the motovend board 215 by communication connection 266, sensor 4 267 is connected to the motovend board 215 by communication connection 268, sensor 5 269 is connected to the motovend board 215 by communication connection 270, sensor 6 271 is connected to the motovend board 215 by communication connection 272, sensor 7 273 is connected to the motovend board 215 by communication connection 274, and sensor 8 275 is connected to the motovend board 215 by communication connection 276. There is also an option for accessing the safes without using the LCD 205 connection to the motovend board 240. A hardware identification 'signature' corresponding to a physical item, such as a data key or card, can be used to provide a data input to the CPU 210 and access the safe using a data key reader 290 connected to the CPU 210 by communication link 292.

FIG. 3 shows a block diagram of the control interfaces from the CPU. Control interface 317 connects the CPU 300 to the liquid crystal display (LCD) 320. The LCD 320 includes a touch sensitive screen and is the primary means to provide control and security inputs to the CPU 300. It is also the primary means for store employees to monitor and control operation of the computerized functions of the drop safe through the CPU 300. The LCD 320 also provides operation and information feed back from the CPU 300 to store employees, permitting control inputs to generate reports, view historical information, edit information stored in a CPU non-volatile memory, input information on currency deposited into the drop safe, request coin tube motovend vending, or request currency dispensing from the bill acceptor's currency cassette.

The CPU 300 also connects directly to a printer 325 using interface 323. Using the printer 325, store managers or employees can print various reports upon request or the computer program can automatically print reports, such as end-of-shift accounting reports, daily accounting reports, courier currency pick up reports or receipts, or diagnostic reports. The CPU 300 also connects to a video camera 330 using control interface 327. The security protocols of the program can be set to activate a video camera 330 under specified circumstances, such as receipt of a vending request, vault door unlock command, or unauthorized input, or at a specific time such as end-of-shift or end-of-day.

CPU 300 also has a control interface 333 to a modem 335. This interface 333 and modem 335 provides a point-to-point dial-up connection over the telephone system and can be used for remote control of the drop safe and to provide a point-of-sale (POS) interface to the computerized drop safe via. The CPU 300 can be controlled using control interface 333 from the modem 335 to provide centralized accounting, vending options, and secure vault access options. Currency deposit information or other information stored on the CPU 300 non-volatile memory can be accessed using this POS/modem connection 335, and the modem 335 can be used to provide secure remote and centralized control for dispensing currency from the currency cassettes, vending coin tubes, or unlocking vault doors, if appropriate security measures are undertaken. This modem connection 335 also permits remote access to the CPU 300 to generate any of the available reports generated or parsed by the computer program, make software updates to the computer program, or access other data elements stored in the memory.

The CPU 300 also has a control interface 337 to an Ethernet connection 340 and a control interface 353 to a RS-485 serial port connection 355. The Ethernet connection 340 and/or RS-485 connection 355 provides the option for a Local Area Network (LAN) that can perform back office applications and POS accounting and other control functions just as can be accomplished using the modem 335. The CPU 300 can communicate transaction, configuration, or user information to the software application, or accept such information onto the LAN. This information can include currency deposit information, courier pickup information, currency dispensing information and control, vending coin tubes information or control, or vault door control. Reports generated by the computer program can also be remotely requested and viewed and software updates to the computer program can be made. The same centralized monitoring and control options available using the modem connection 335 can be implemented using the LAN.

Control interface 343 connects CPU 300 to bill acceptor 1 345, and control interface 347 connects CPU 300 to bill acceptor 2350. The bill acceptor 1 345 and bill acceptor 2 355 include a denomination sensor for sensing the denomination of the deposited bill and storing this information or updating the information in the CPU memory for accounting and tracking the amount of currency deposited in the cassette. The bill acceptors 345 and 347 can also include a currency recycler that can dispense currency out to the employee. Another feature of the CPU 300 control over the acceptors 345 and 347 is to alternate operation so that currency deposits can be made alternating between the two acceptors. Normally, there is a 1.5 second lag between bill deposits into a bill acceptor while the mechanism cycles the bill into the storage cassettes and resets to accept another bill input. By alternating between the two acceptors, the rate of currency deposits is significantly increased.

There is also a control interface 357 to the motovend 360 to control coin tube deposits and vends. Coin tubes can be inserted into one or more of the eight slots for depositing rolls or tubes, of quarters, dimes, nickels, pennies, or tubes of currency. These rolls and tubes are kept secured in the drop safe until a vending operation is required to replenish the cash register or to dispense for a courier pickup or management audit of contents. It can also be used to vend tubes of currency. The motovend 360 is controlled by the CPU 300 to vend tubes either from an employee input on the LCD 320 or from a remote command over the modem 335 or Ethernet 340 interfaces. There is also a control interface 303 connecting the drop vault lock assembly 305 to the motovend 360. The motovend 360 connects to the bill acceptor vault lock assembly 310 using control interface 307, and the motovend 360 connects to the courier vault lock assembly 315 using control interface 313. The electronic lock itself uses an electric solenoid to secure the vault door, but any basic electro-mechanical locking mechanism can be used to secure the vault doors. The security software application operating on the CPU 300 controls when the vault doors can be opened using the control interface 357 to the motovend 360.

In the preferred embodiment, the doors cannot be opened by store employees using a key, although if desired a key option can be used, such as preferred for a courier pickup of vault contents. There is a data key reader 370 connected to the CPU 300 by communication link 369 that permits an entry into the vaults using a physical key. The data key reader 370 is used to provide a hardware identification signature capability for safe access based on a physical item such as a data key or magnetic strip imprinted data card.

The Software Features

Figure 4:
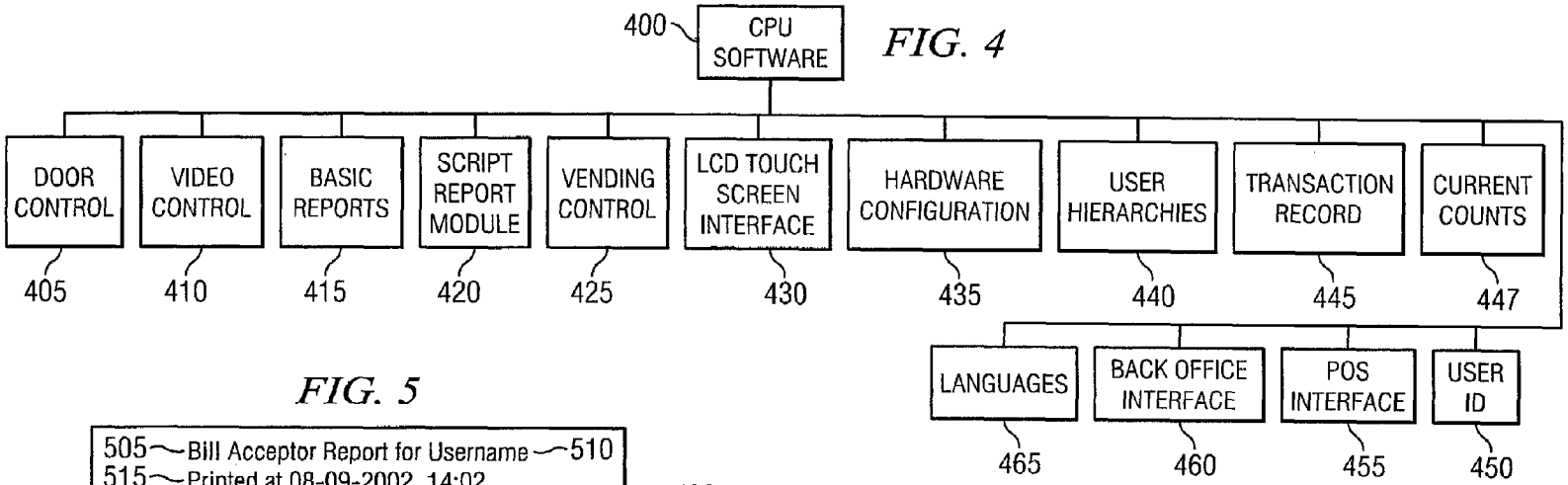
FIG. 4 is graphic display of the software subroutines and subprograms operating on the CPU.

The CPU of the computerized drop safe operates and controls the drop safe using a programmable software package. The software program of the computerized drop safe incorporates a number of features in the preferred embodiment. Referring to FIG. 4, the computer software subroutines and/or subprograms operating on the CPU support operational functions of the computerized drop safe. The CPU software 400 operating on the computer offers retail businesses considerable flexibility to tailor their security protocols and procedures.

In the preferred embodiment, the CPU software 400 door control subroutine 405 can control access to the three vault doors. The door control subroutine 405 configuration generally only permits timed entry, unlocking a door and allowing vault access after a ten minute delay, although this delay feature can be eliminated or even extended. Vault access can be configured according to a series of logic rules controlling who can gain access to a given vault compartment. These rules include:

1) Can or cannot be opened by a manager.

2) Can be opened immediately by a courier, immediately with manager PIN, immediately with any employee PIN, or cannot be opened immediately by anyone.

3) Can or cannot be opened by a clerk (storage vault only).

4) Can be opened immediately (storage vault only).

Manager user accounts can be configured not to allow vault opening or to allow vault opening. Executive accounts can open any vault but must wait the required time. The doors can also be set to not open during a given period of the day or given period(s) of the week. The doors can also be set to have a shorter or longer wait than 10 minutes for earlier or later opening by selected user accounts.

As another security feature, the door control subroutine 405 restricts vault access to manager or executive hierarchy users that verify their identity via either a personal identification number (PIN) or hardware identification (ID) method at the safe location and then can request to open a vault door open. Another security enhancement available is an internal timer countdown embedded in the various policies that can lockout vault door access either because of unauthorized access attempt, lack of manager permission, or a control input. Once the internal countdown starts, vault access cannot be obtained because of the lockout in effect. When the timer countdown is complete, an indicator on the LCD screen shows countdown complete and door access now permitted. A manager or executive level user can then identify himself or herself to the CPU processor by an appropriate input at the safe location, and request unlocking the vault door. The software then opens the vault door according to that command input to the safe at the safe location and the implemented software security protocol. Another possible security option is to implement a secure remote, centralized door unlocking protocol using a modem or a LAN command input, if appropriate security measures are undertaken. The door control subroutine 405 can also control access using double login door control that requires two employees logging into the system at the safe location to open the safe.

The video control subroutine 410 activates a digital video recorder linked to the computerized drop safe. If a specified event transpires, the CPU software 400 activates a digital video recorder to record the immediate vicinity around the safe and provide a video graphic record for review of the person or persons in the vicinity around the safe when the specific event occurred. The specified event can be any of several sensor inputs available, such as a safe door opening, a bill acceptor cassette removed, a bill acceptor cassette dispensing, a wrong or invalid PIN input, a vending operation, an employee data entry (e.g. security alarm), or some other option. The image of the person or persons responsible for creating the specified event should be captured by the video recorder. The digital video recorder will record the safe and the immediate vicinity for a specified period of time. The video recorder can also be tied into an alarm system.

The basic report generating module 415 of the CPU software 400 supports generation of several general types of reports:

1) Transaction Report: The data inputs from the various safe components can be logged into the CPU memory as transaction such as a currency transactions (e.g. currency deposit into the bill acceptor) or a hardware transaction (e.g. drop vault slot open). These logged transactions track safe functions and currency deposits and withdrawals and are used to audit machine usage. The software can print transactions by time, by type, or by user name.

2) Financial-based Reports: Several report formats are available and can break down usage by shift, by specified time period, and by business day. These various reports incorporate data from the transactions to generate reports for accounting and management review of actual receipts.

3) Setup Report: Describes the configuration and security policies operating on the drop safe. The setup report shows how the safe is configured for control by the various hierarchal accounts.

4) Exception Report: Describes any atypical software failures noteworthy to the programmer.

Figure 5:
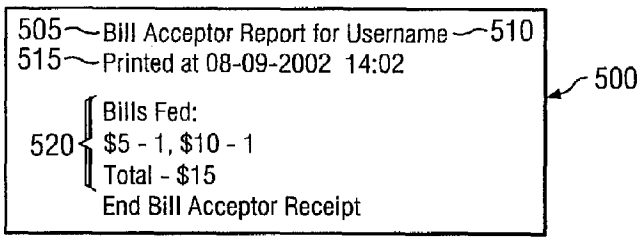
FIG. 5 is an example of a Bill Acceptor Report.

Several basic representative reports are shown in FIGS. 5-19 that may be implemented using the software. FIG. 5 shows an example of a Bill Acceptor Report 500. This transaction report is generated from the "Insert Bills" menu on the LCD after bills are inserted into the bill acceptor and a data input for "done" is made. The report includes a report identity 505 and the user identity 510 causing generation of the report. The time and date 515 of report generation, and the number, denomination, and total of the currency deposited 520. The Bill Acceptor Report list user inserting the bills, number and denomination of the bills, and total value of bills inserted in the transaction.

Figure 7:
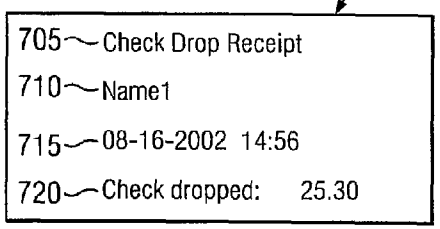
FIG. 7 is an example of a Check Drop Receipt.
Figure 6:
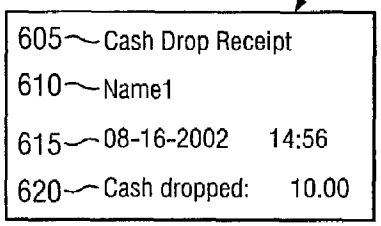
FIG. 6 is an example of a Drop Report.

FIG. 6 shows an example for a Cash Drop Receipt Report 600. This transaction report is generated whenever a cashier deposits currency into the drop vault. The report 600 includes the name of the report 605, user identity 610 of the person making the drop, the date and time 615 of the drop, and the cash amount 620 dropped. FIG. 7 show an example for a Check Drop Receipt Report 700. This transaction report is generated whenever a cashier deposits checks into the drop vault. The report 700 includes name of the report 705, the user identity 710 of the person making the drop, the date and time 715 of the drop, and the check amount 720 dropped.

Figure 8:
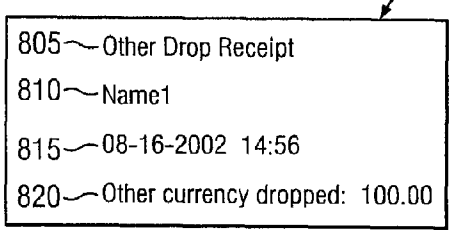
FIG. 8 is an example of an Other Drop Receipt.

FIG. 8 show an example for an Other Drop Receipt Report 800. This transaction report is generated whenever a cashier deposits other receipts, such as credit card receipts or coin tubes, into the drop vault. The report 800 includes name of the report 805, the user identity 810 of the person making the drop, the date and time 815 of the drop, and the amount 820 dropped. FIG. 9 shows an example for a Total Drop Report 900. This transaction report is generated upon user request for a specified time period or according to a user configured schedule. The report includes the name of the report 905, the date and time 910 the report is generated, the date and time 915 that a drop was made, the identity 920 of the person making the drop, the type 925 of the drop, the amount 930 of the drop, the total amount of cash dropped 935, the total amount of check receipts dropped 940, the total amount of other receipts dropped 950, and an indicator of the end of the report 955.

FIG. 10 shows an example for a Transaction Report 1000. The Transaction Report 1000 includes the name 1005 of the report, the date and time 1010 the report was printed, the date and time period covered 1015, the date and time of the transaction 1020, the identity 1025 of the person making the transaction, the transaction type 1030, and an end of report indicator 1035. Transaction types that may be tracked by the software include, but are not limited to, the following:

1) Storage Vault Open: Logged when storage vault is unlocked by a user.

2) Acceptor Contents: Prints amount of currency stored in the bill acceptor currency cassette prior to courier withdrawal.

3) Acceptor Emptied: Logged when courier opens acceptor vault door to remove the currency cassette or a clear acceptor command is received by the CPU.

4) Acceptor Open Request: Logged when the CPU receives an open request for the acceptor door that accesses the currency cassette storage.

5) Acceptor Vault Close: Logged when the bill acceptor door handle turns to lock by a user.

6) Acceptor Vault Open: Logged when the bill acceptor door handle turns to unlock by a user.

7) Acceptor 2 Open Request: Logged when the CPU receives an open request for the acceptor door, but on a second acceptor vault, if present, that accesses the currency cassette storage.

8) Acceptor 2 Vault Close: Logged when the bill acceptor door handle turns to lock by a user, but on a second acceptor vault, if present.

9) Acceptor 2 Vault Open: Logged when the bill acceptor door handle turns to unlock by a user, but on a second acceptor vault, if present.

10) All Acceptor Types: Prints all bill acceptor activity performed within the date range selected. This activity can include each bill deposit into the acceptor and each bill dispensed out of the acceptor tracked by denomination and user.

11) All Door Types: Prints all door and drop chute activity performed within the date range selected. Examples of logged activity include a user accessing the drop chute, the drop vault through the door, or the storage vault door.

12) All Types: Prints all activities performed with the date range selected.

13) All Vend Types: Prints all vending activity performed within the date range selected.

14) Beginning Balance: Logged after an End of Day performed. Beginning balance is amount in the unit at time End of Day performed. Balances for following logged: a) total of all tubes, b) total drops by cash/check/other, c) total in drop vault by cash/check/other, d) total in storage vault by cash/check/other, and e) total in Bill Acceptors. Can also be logged after an End of Shift is performed.

15) Bill Accepted: Prints number and types of bills loaded in bill acceptor.

16) Bill Acceptor Failed: Logged when the bill acceptor reports an error condition to the CPU. Examples can include no denomination detected, failure to feed into cassette, cycling incomplete, or no power.

17) Bill Acceptor Full: Logged when the cassette is full of deposited bills.

18) Bill Acceptor Jammed: Logged when the bill acceptor reports a jammed condition to the CPU.

19) Bill Acceptor Not Full: Logged when successful bill load detected after a "Bill Acceptor Full" condition reported.

20) Bill Acceptor Recover: Logged when the bill acceptor reports an operational condition after a "Bill Acceptor Failed" condition reported.

21) Bill Acceptor Unjammed: Logged when a successful bill load is detected after a "Bill Acceptor Jammed" condition was reported.

22) Bookmark: Logged whenever a bookmark is fed into a bill acceptor. Can be used to demarcate the bills deposited between one shift and the next, end of day, or some other significance.

23) Cassette Removed: Logged when the cassette is removed from the bill acceptor and includes the total of the bills in the cassette.

24) Cassette Replaced: Logged when the cassette is replaced in the bill acceptor after a "Cassette Removed" logged.

25) Cheat Detected: Logged when the bill acceptor detects bill travel away from the cassette. This can include when the bill acceptor rejects a bill fed into the acceptor or when a bill is manually withdrawn by the clerk.

26) Clerk Tube Loaded: Logged when a cashier loads tubes using the Load Tubes selection. The column loaded, number of tubes loaded, and total value of the tubes located is reported.

27) Cold Start: Logged whenever a Cold Start is performed in the Troubleshooting Menu.

28) Cold Start Request: Logged whenever a Cold Start is requested in the Troubleshooting Menu.

29) Column Config: Logged when the values to the tubes are changed in the Cash Control Menu of the setup.

30) Courier Key: Logged when the Courier key is used to open a vault door.

31) Courier Retrieval: Logged when the courier tray or bill acceptor is emptied after the Courier opens the vault.

32) Dispensed: Prints recycler transactions for the date range selected. Includes the denomination and number of the bills dispensed.

33) Door Whine: When a door is left open for extended periods of time, a warning is displayed on the LCD which prompts the Manager for a code entry to clear. This is logged by the CPU as a door whine.

34) Door Whine Override: Logged when the Manager enters a code to clear a Door Whine.

35) Drop Chute Open: Logged when the CPU detects the drop chute on the drop vault door pulled to open position.

36) Drop Chute Close: Logged when the CPU detects the drop chute return to close position.

37) Dump Column: Logged when dumps are requested from the Cash Control Menu. Report lists user requesting the dump, number of tubes in the column, and the total value of the tubes.

38) End of Day: Logged each time an End of Day is selected within the date range selected.

39) File Reloaded: Logged when a data set has been reloaded from a compact flash card. A compact flash card is a data memory storage device about the size of a matchbook or credit card. For this implementation, compact flash would only be used during factory installation or during service replacement of the CPU and would be used to reload operating software of other data. The presence of a compact flash card reload at any other time may indicate a sophisticated attempt at fraud.

40) Main Vault Opened: Prints the date, time, and by whom the Main Vault was opened within the date range selected.

41) Main Vault Close: Prints the number of times the main vault was shut and locked within the date range selected.

42) Manager Tube Loaded: Logged when the Manager loads tubes using the Load Tubes selection. Prints columns loaded, number of tubes loaded, and value of the tubes loaded and can be associated with the Manager name loading the tubes.

43) New User: Logged when a Clerk (e.g. Cashier), Courier, Executive, or Manager account is added.

44) Notation: A 16-character text note entered by the courier or manager at time of a pickup or deposit. Can be used to record a seal tracking number for a seal securing a container of store receipt pickups.

45) Policy Change: Logged when changes are made to the Policy Setup. The logged user account making the changes is also recorded.

46) Program Starts: Logged whenever the operating software on the CPU starts. If the CPU is restarting too often, it may signify power failures caused by electrical faults and problems or attempted fraud.

47) Remote Code Issued: Logged whenever the CPU issues an override key code.

48) Remote Code PIN Entered: Logged whenever someone enters a remote PIN access code for remote access to the drop safe using the modem, Ethernet or LCD access.

49) Remote Code Verified: Logged whenever the safe verifies that the corresponding response to the override key code is correct.

50) Second Vault Close: Logged when the CPU detects the handle of the storage vault turned to close position.

51) Second Vault Open: Logged when the CPU detects the handle on the storage vault turned on the storage vault to unlock position.

52) Shift End: Logged when an authorized user presses the shift end button. A shift is a subdivision of the business day and generally consists of three eight hour periods with specified start and stop times.

53) Time Changed: Logged when the date or time is changed in the Manager or Executive Menu.

54) Too Many Bad PINs: Logged when four consecutive incorrect PIN code entries are made. If seven incorrect PIN codes are entered, the system locks the user out barring access until cleared.

55) Tube Adjustment: Logged when the number of tubes is changed in the Cash Control Menu. The report will list which column was adjusted, number of tubes added or subtracted, and the total value of the tubes.

56) Tube Vend: Logged when a tube vend process begins. Includes column number and tube value, in cents, dispensed by the motovend.

57) User Change: Logged when changes are made to a user PIN, name or permission.

58) User Deleted: Logged when an authorized manager deletes a clerk, or when an executive user deletes any other account.

59) User Says Bad Vend: Logged when the user selects Report Problem after vending a tube. Report will list the user name, the column, value of the tube, and the reported problem.

60) Vault Move: Logged whenever an Adjust Vault Contents or More Vault Contents are performed. Report will list user performing the transaction, the amount of the transfer, type of transfer, and where transfer was moved to and from.

61) Vault Open Request: The Executive or Manager selects the desire vault in the Vault Open Menu.

62) Vend Failed: Logged when the CPU detects an error in the vending process (e.g. defective sensor, stripped gears, etc.)

FIG. 11 shows an example of a Courier Deposit Report 1100. This transaction report reports the currency a courier delivers and deposits into the safe. The report 1100 includes the name of the report 1105, the date and time 1110 of the deposit, the courier identity 1115, a statement 1120 of the amount of currency deposited and into which vault that the courier (using the courier identity 1115) deposited the currency, and an end of report identifier 1125.

FIG. 12 is an example of a Courier Withdrawal Report 1200 that can be implemented using the program. This transaction report shows the amount of currency picked up by a courier and breaks the receipts down by category. The report 1200 includes the name of the report 1205, an identifier for the store 1210, the print date of the report 1215, the courier's name/identifier printing the report 1220, the date range 1225 of receipts in the pickup, total value of the pickup 1230, amount of cash in the pickup 1235, the number and value of the checks in the pickup 1240, the contents of the bill acceptor 1245 broken down by denomination to list number of bills in each acceptor 1246, total number 1247, and total value 1248. Receipts are also broken down by business day 1250. For each business day, the report list the date and time of the end of the business day 1251, amount of acceptor cash 1252, the amount of cash deposits 1253 in the courier tray, the amount of check deposits 1254 in the courier tray, the amount in other deposits 1255 in the courier tray, and the total deposit value 1256. The end of the report 1260 is also indicated. This report can be used as a receipt from the store to a courier detailing the receipts picked up by a courier.

FIG. 13 shows an example for a Courier Content Report 1300 that can be implemented using the program. This financial-based report provides similar information found in the Courier Withdrawal report 1200 to provide information for store management in a slightly different format. The report 1300 includes the name of the report 1305, an identifier for the store 1310, the print date of the report 1315, the user identifier of the person printing the report 1320, the date range 1325 of receipts covered by the report (e.g. from one courier pickup to the next), totals of receipts in the pickup 1330. The totals are broken down by amount of acceptor cash 1331, courier tray cash deposits 1332, courier tray check deposits 1333, courier tray other deposits 1334, and total deposits 1335. These totals are further broken down and detailed by business day 1340. The business day of the receipts is found at the date and time 1341 of the deposit, the acceptor cash deposits 1342, the courier tray cash deposits 1343, the courier tray check deposits 1344, the courier tray other deposits 1345, and the total deposits 1346. An end of report identifier 1355 is also found.

An example of a Current Content Report 1400 that can be implemented with the software is found in FIG. 14. This financial-based report shows the current contents of the drop safe in each vault and the bill acceptors. The report 1400 includes the name of the report 1405, an identifier for the store 1410, the date the report was printed 1415, and the name 1420 of the user requesting the report. The amount of cash in the drop vault 1425, the amount in checks in the drop vault 1430, the amount in other in the drop vault 1448, and the total in the drop vault 1440.

The storage or courier vault is broken down into two separate categories in this example. The current vault amounts represent stored cash on hand receipts segregated from receipts designated for courier pickup. The cash 1446 represent stored cash, the check 1447 represents stored checks, the other 1448 represents other receipts, and the total 1449 represents the total value of the receipts stored in the vault. The courier amounts represent store receipts designated for courier pickup. Current courier tray cash 1450 represents cash receipts for courier pickup, current courier tray check 1455 represents the check receipts for courier pickup, current courier tray other 1460 represents the other receipts for courier pickup, and the current courier tray total 1465 represents the total receipts for courier pickup.

The Column Contents 1470 tracks the tube count by columns of tubes in the motovend inside the safe. Each tube (or roll) is deposited through a tube-slot into the motovend's storage columns. The report 1400 list each column 1471, the number of tubes 1472 in each column, designated tube values 1473, and total value of the currency in each column 1474.

The Bill Acceptor Contents 1475 lists the contents in each of the bill acceptors by denomination 1476, by each individual acceptor 1477, by total of each domination 1478, and by total value for each denomination 1479. A data reporting row includes unrecognized currency deposited 1480 and all currency deposited 1481. There is also an end of report indicator 1485.

FIG. 15 shows a Shift Report 1500 that can be implemented to provide accounting information for a shift. This financial-based report shows deposit and withdrawal activity from the safe during a specified shift for each user programmed into the CPU and making a transaction. The report 1500 includes a report identifier 1505 for the report, the time and date 1510 the report was printed, the date and time range 1515 covered by the report, a shift identifier 1520, the date and time range 1530 covered by the shift, the name of the clerk/cashier 1535 making the listed transactions, the number and value of tubes loaded 1536, the number and value of tubes vended 1537, the number (and value) of empty vends 1538, the number and value 1539 of bills fed into the acceptor, the number and value of vault drops with cash 1540, the number and value of vault drops with checks 1541, and the number and value of vault drops other 1542, and the net value of the deposits 1543.

The tubes vend information is further broken down into vend details 1545. This includes the number of tubes vended from each column 1546 and the number of tubes loaded 1547. The bills acceptor is broken down into a record of the bills accepted 1550. This includes the denominations 1551, the number of each denomination deposited 1552, the total value of the accepted currency 1553, and also a row for number of unrecognized bills deposited 1554 and for all bills deposited 1555. The above information will be repeated for each user programmed into the CPU and cover each shift requested. There is an end of report indicator for the report end 1575.

FIG. 16 shows an example of a Summary Report 1600 that can be implemented using the software. This financial-based report shows deposit and withdrawal activity from the safe during a specified period and specific actions performed by a clerk. The report 1600 includes an identifier 1605 for the report, the date and time the report is printed 1610, the time and date range 1615 covered by the report, and the name/identifier for the person printing the report. Beginning balances 1625 are shown that are the total amounts in the safe at the time the End of Day was performed that ended the reporting period and include entries for the beginning balances in the tubes 1626, drop vault total 1627 (then broken down by cash 1628, check 1629, and other 1630, storage vault 1631, courier tray 1632, and bill acceptors 1633. The net balances 1635 is the difference between what was deposited into the safe versus what was withdrawn during the time period reported for the tubes 1636, the drop vault 1637, the storage vault 1638, courier tray 1639, and bill acceptors 1640. Deposits 1645 show the deposits made into the safe during the time period reported and includes number of tubes and value loaded by the clerk 1646, number of tubes and value loaded by the manager 1647, positive adjustments by the manager for tube deposits 1648, cash drops 1649, check drops 1650, other drops 1651, storage vault deposits 1652, courier drop offs 1653, courier tray deposits 1654, and bill acceptor deposits 1655. Withdrawals 1660 show the withdrawals made from the safe during the time period reported and includes the number and value of the tubes vended 1661, the number and value of tubes dumped 1662, negative adjustments by the manager for tube deposits 1663, drop vault withdrawals 1664, storage vault withdrawals 1665, courier tray withdrawals 1666, and bill acceptor withdrawals 1667. Current totals 1670 shows the current amounts in the tubes 1671, in the drop vault as cash 1672, in the drop vault as checks 1673, in the drop vault as other 1674, in the storage vault 1675, in the courier tray 1676, and in the bill acceptor 1677.

Column Contents 1680 tracks the tube count by columns of tubes in the motovend inside the safe. The report 1600 lists each column 1681, the number of tubes 1682 in each column, designated tube values 1683, and total value of the currency in each column 1684. The Bill Acceptor Contents 1685 lists the contents in each of the bill acceptors by denomination 1686, by each individual acceptor 1687, by total of each denomination 1688, and by total value for each denomination 1789. A data reporting row includes unrecognized currency deposited 1690 and all currency deposited 1691.

The Door Opens record 1692 shows the number of door openings by user within the reports time range. There is a column entry for clerk 1693, manager 1694, courier 1695, and unknown 1696. The unknown entry cover vault door openings when no user is logged onto the system. Each row covers a separate opening into the safe and includes the main vault 1697, the drop chute 1698, the bill acceptor 1699, and the storage vault 1700.

The Column Activity 1701 record summarizes tube transactions from the motovend. Each column in the motovend is identified in the column row 1701. The entries for each column include normal vends 1703, clerk loads 1704, manager loads 1705, manager adjustments 1706, dumps 1707, no vends 1708, empty vends 1709, and wrong vends 1710. There is also a column for all the columns 1711 and the total value 1712 of vends. Bill Acceptor Activity 1715 record summarizes all bills deposited into each bill acceptor by all users. There is a row for each denomination 1706, an entry for the number of each denomination deposited in each acceptor 1709, and the total number of bills deposited 1710. There is also a row showing the number of bills deposited in each acceptor 1707, and the value of the currency deposited 1708.

Finally, there is a listing of drops and bill acceptors for each user 1721. The listing has the user identifier 1722, a row for bills accepted 1723, cash drops 1724, check drops 1725, other drops 1726, and tubes vended 1728. A column lists the number of transactions 1729 and the value of the transactions 1730. There is an identifier for the end of the report 1740.

FIG. 17 shows a Setup Report. The report 1800 includes a report identifier 1801 and list information on the software program versions installed on the CPU 1805. The setup includes the specified values 1810 of the currency stored in the motovend's columns. Each of the eight columns 1811 in the motovend are listed. The currency denominations 1812 in the tubes stored in each column are also defined. Currency denominations stored in the tubes include coins (e.g. $0.01, $0.05, $0.10, $0.25) and currency (e.g. $1.00, $5.00, $10.00, and $20.00 bills). The amount of currency for each currency denomination is also defined (e.g. 50×.$0.01, 40×$0.05, 50×$0.10, 40×$0.25, 10×$1, 4×$5, 2×$10, and 2×$20). Finally, the value of currency 1814 in each tube stored in the columns is listed.

Various vault door and vending time settings and protocols 1815 are listed. The COURIER_SUBJECT-TO_LOCKOUT 1816 determines if the courier can open the vault when the Daily or Weekly lockouts are enabled. The DOOR_DELAY 1817 specifies the length of the standard door opening delay shown in seconds (e.g. 0000600=600 seconds=10 minutes). The WEEKLY_LOCK_ENABLED 1818 if enabled prevents door opening during time periods set in the Executive Policy. The DAILY_LOC_ENABLED 1819 if enabled prevents door opening during time periods set in the Executive Policy. DAILY _LOCK 1820 shows the programmed start time and duration of the lock down period. PROGRAMMABLE_VEND_ENABLED 1821 if enabled delays the time vending operations occur according to the Alternate Vend Interval value programmed in the Executive Policy. The ALT_VEND 1822 list the Alternate Vend Interval in seconds (e.g. 000030=30 seconds). If enabled, the ALT_DOOR_ENABLED 1823 specified that the opening door time delay setting will follow the Alternate Door Delay time in the Executive Policy, and, if not enabled, the door time delay follows the standard door opening time delay. ALT_DOOR_DELAY 1824 shows the vault door opening delay in seconds.

The Setup Report 1800 also displays peripheral information 1825. STAM PORT 1826 is a communication port. BILL_READER_CONFIG. 1827 shows the configuration settings of the bill acceptors connected to the CPU. Users will stay logged on until the LOGOFF button is selected when SINGLE_USER_MODE 1828 is enabled. The IBUTTON_PORT 1829 indicates where the Ibutton is connected, if used. MOTOSLAVE_PORT 1830 indicates where the safe's main printed circuit board is connected. The DEBUG_PORT 1831 shows the location of the diagnostic port and is not used by the operator. LOGGER_ENABLED 1832 is for internal use and not used by the operator.

Vault door settings 1835 are shown in the report 1800. MAIN VAULT 1836 indicates who can open the main vault door. READER_VAULT 1837 indicates who can open the bill acceptor vault, and SECONDARY_VAULT 1838 indicates who can open the door of the storage vault and if there is an opening delay time or instant opening. Printer information 1840 is also shown on the report 1800. PRINTER 1846 indicates the printer type configuration. DROP_RECEIPT 1842 specifies the number of receipts printed when a drop is performed. COURIER_RECEIPT 1843 shows the number of receipts printed when the Bill Acceptor and Courier Tray are emptied after the Courier opens the vault. ACCEPTOR_RECEIPT 1844 specifies the number of receipts printed when deposits are made into the Bill Acceptor. VAULT TERM 1845 sets the terminology to print on the reports.

Miscellaneous settings 1850 shows a number of miscellaneous information entries. LOTTERY_PORT 1851 indicates the connection for a connected lottery terminal. STORE_IDENTIFIER 1852 indicates the name used for the store location. SHIFT_INACTIVE 1853 indicates if the automatic "shift ending" feature is active and the number of hours of inactivity required before activating a shift end transaction. ACCEPTOR_SEAL 1854 indicates whether or not Bill Acceptors seals are being used. If enabled, PIN_LOCKOUT 1855 causes a ten minute lock down of the safe if seven incorrect PIN code entries are made. If enabled, DVR_ENABLED 1856 activates the digital video recorder control protocols. If disabled, ACCEPTOR_ESCROW 1857 sets a faster acceptance time for the bill acceptor, but if a power failure occurs during insertion that bill may not be counted. An identifier for the end 1860 of the report is also present.

Other variations of this report are possible. Other information found in different report variations can include the name of the store and address communication configuration settings (e.g. Media Access Control address (MAC), Dynamic Host Configuration Protocol (DHCP), Internet Protocol (IP) address, etc). Alternate time specifications can be listed such as door delay, vend delay, or time of day options. A log level can be shown indicating how information is stored in the memory for various transactions. There can be an indication of the degree of control and monitoring available on a network connection such as point-of-sale or back-office interfaces enabled or not. Current language settings operating on the safe can be shown in the report. Different settings can be shown for each vault such as whether the courier or clerk can open the vault door and whether a delay is active.

Specifications for the printer output can also be shown in the setup report including the serial port printing is directed toward and number of receipts to print for specified transactions such as when the courier visits, when inserting bills, or when performing vault moves or adjustments. Print options for automatically printing a end of day or end of shift report can be shown. Different settings for the bill acceptor can be reported such as whether a bill escrow function is active, whether bookmarks are enabled so the acceptor can segregate currency by depositing non-currency slips of paper into the cassette, whether security protocols on the acceptor are active, and whether cassette totals are automatically cleared for accounting. Courier key settings can be enabled and shown such as to clear totals and print receipts automatically. Whether a notation option is set can be shown. The number of registers can be shown and whether there is an association with a register (e.g. associating a transaction with a register and print reports associated with that register).

FIG. 18 shows a Manager Description Report 1900. This is a setup report showing the access policies in effect for a particular manager account. The report 1900 has the name of the report 1901, the store where manager is employed 1902, the date and time 1903 printed, and the version of the report or software 1904. The report shows an identifier for the manager 1905 and the manager's PIN code 1910. The Vend Limit 1915 is the maximum amount that can be vended from the motovend in a single transaction. There is also a list of privileges 1916 allowed for that manager.

Can print reports 1917 allows the manager to print reports from the CPU interface. Can load tubes 1918 allows the manager to load tubes into the safe. Can end business day 1919 allows the manager to clear the reports for the business day, updating the internal memory, and begin a new business day reporting period. Can end shift 1920 allows the manager to clear the reports for the shifts, updating the internal memory, and beginning a new shift reporting period. Language English (United States) 1921 shows the set language option for the manager. Can open storage door 1922 allows the manager access to the storage vault. Can change own PIN 1923 allows the manager to change his own PIN number. Can open main vault door 1924 gives the manager access control to the main vault door. Can open acceptor vault door 1925 gives the manager access control to the acceptor vault door securing the cassettes. Can activate alternate vend 1926 allows the manager to activate the alternate vending interval time instead of the standard two minute vend time delay. Can activate time of day vend interval 1927 permits the manager to activate this feature to vary the vending interval at specified times during the day. Can activate time of day or week lockout 1928 permits the manager to activate this feature to lockout the access to the safe at specified times.

Can dump tubes 1929 allows the manager to dispense all tubes trom a selected column (e.g. a tube dump). Can adjust tube count 1930 allows the manager to add or subtract the number of tubes reported in a given column. Can move vault contents 1931 allows the manager to add, remove, or transfer the amounts currently in the vault from one vault to another, logging the amount of the transfer (e.g. moving drop vault deposits into storage vault). Can adjust vault drops 1932 allows the manager to adjust the value in the drop vault. Can adjust reserve (main vault) 1933 allows the manager to adjust the amount inside the reserve, or storage, vault. Can adjust courier tray 1934 allows the manager to adjust the value in the courier tray. Can edit, add, and delete clerk accounts 1935 permits the manager to modify the clerk account information and policies. Can NOT edit, add, and delete managers 1936 locks out the specified manager account from making any changes to manager level accounts. Can clear acceptor counts 1937 allows the manager to reset the number of bills and amounts reported in the bill acceptor to zero. Can NOT configure columns 1938 prevents the manager from making any changes to the column values and configuration. The end of the report is also identified 1939.

FIG. 19 shows a Clerk Description Report 2000. This is a setup report showing the access policies in effect for a particular clerk account. The report 2000 has the name of the report 2001, the store where the clerk is assigned 2002, and the date and time 2003 printed. The report or software version 2004 is also shown. The report shows an identifier for the clerk 2005 and the clerk's PIN code 2010. The vend limit 2015 is the maximum amount the clerk vend from the motovend in a single transaction. There is also a list of privileges 2016 allowed for the clerk. Can print reports 2017 allows the clerk access and permits printing up command all available reports. Can load tubes 2018 indicates the clerk is allowed to load tubes into the motovend's columns. Can NOT end business day 2019 means that the clerk is not authorized to close out the accounts at the end of the business day. Can NOT end shift 2020 indicates the clerk is not authorized to close out the accounts at the end of the shift. Language English (United States) 2021 shows the set language option for the manager. Can NOT open storage door 2022 indicates that the clerk can not access the storage vault door. Can change own PIN 2023 indicates that the clerk can change the PIN associated with their name. End of Clerk Report 2024 marks the end of the report 2000.

The Report Script Subprogram

Referring back to FIG. 4, the report script module or integrated sub-program 420 operating on the CPU 400 is an important, innovative feature to the invention.

1. The Computer Code

The computer within the safe understands an interpreted language that uses BASIC (Beginners All-purpose Symbolic Instructional Language) as its core programming language. The script software is written in the BASIC language in the invention as the preferred embodiment, but other languages may be the core and are within the scope of the invention. Some features of BASIC, like Write, are not supported. Numerous other features have been added that permit the script writer to access accounting and content information.

The report script uses Unicode as its data format and to print out the various reports that the program generates. Unicode uses two bytes to represent a single character of a language data set. Many documents generated by computer programs are written in ASCII, which uses one byte to represent a single character. However, ASCII is limited to a language with a character data set of no more than 256 characters, such as English. Numerous languages use more than 256 characters, such as That, Japanese, and Hebrew, requiring Unicode format data to display the language. Report scripts are written on a personal computer using a Unicode text editor (e.g. Microsoft Word) and then imported to the CPU. The CPU later parses the report script to generate the report.

2. Script Usage

The script language in this report writing subprogram can be used by a customer after purchase and delivery of the computerized drop safe with minimal computer language skills and does not require any advanced computer language and developer skills to write customized reporting formats program instructions to generate customized report formats. That is, a user can easily write the formatting script program without taking any specialized training or learning a computer language or code to write a program to generate the desired report formats. FIG. 20 shows a flow diagram of the program's operation. The CPU begins start up in step 2105. In step 2110, the CPU searches for files in its permanent memory storage that have a "b" suffix. These "b" suffix files are report scripts. In step 2115, the CPU briefly examines the files to determine the file name and print time—that is, when the file should be printed. Time designations include: 1) printed on courier visit, 2) on end-of-shift, 3) on end-of-day, or 3) when requested from the Report screen.

In step 2120, the script is invoked, or run, and the computer reads the script file and parses the contents into BASIC instructions. If the parsing fails, as is common during script development, an error message is briefly displayed describing the problem and where within the file the problem was encountered. Note that the entire file is parsed, so the developer is assured that once a script parses without error, it will always parse without error afterwards. If the script program successfully parses the file contents, a stream of Unicode characters formatted into the generated report will appear. The report will contain the name of the report, when it was printed, and by whom.

Every valid script contains four features at the beginning of the script file, called headers, that are commented-out with the # symbol. There are also four optional features: BY_USER, CLERK_PRINT, LAST_INTERVAL, and INCLUDE. Headers can include the following:

1) SCRIPT_NAME: This is the name that will be printed at the top of the report. For reports printed from the Report screen, this is also the text displayed in the button on the LCD for that report.

2) REPORT_TYPE: This indicates when the report should be printed. Options contained in the script that can be specified in this script are as follows:

a) SCREEN: Used to specify printing from Report screen.

b) COURIER_PICKUP: Used to specify printing after a courier pickup.

c) MANAGER_PICKUP: Used to specify printing after bill acceptor vault access.

d) END_OF_SHIFT: Used to specify printing at the end of a shift.

e) END_OF_DAY: Used to specify printing at the end of a business day.

3) INTERVAL: This indicates how the CPU should gather data for including in the report stored in its memory. Options available in the script include:

a) BY_BUSINESS_DAY: Used if the report contains data for a given business day. If this is a SCREEN report, a dialog input allows the user to select the business day.

b) BY_BUSINESS_DAY_WITH_SHIFTS: Used if the report contains data for a given business day and shift. If this is a SCREEN report, a dialog input will allow the user to select which business day and shift. A report script with this option is best suited for generating or reprinting a shift report.

c) BY_PICKUP: Used when the report contains information for a period of time demarcated by courier pickups. Typically, the report interval will be business days.

d) CURRENT: Used if the report only uses current inventory information.

FAMILY: This header can segregate groups of reports into 'families'. For example, a customer may wish to have two different sets of reports, depending upon the type of back-office software they have. The manager or executive can select from the policy screen which family of reports to use.

BY_USER: This SCREEN-only option allows the operator to select whether to run the report on all users or on a specific user.

CLERK_PRINT: This option indicates that clerks can print this report from their report screen. It is only applicable to SCREEN report types.

7) LAST_INTERVAL: This SCREEN-only option specifies that the last interval should be used for the report. This means that the safe will not present a screen for the user to select which interval (courier pickup, business day, or shift). Instead, the report script generator uses the interval from the last courier pickup, end of day, or end of shift to the current time. This option cannot be used with INTERVAL CURRENT.

8) INCLUDE: This option is always followed by the name of another script file. The text inside of the named file is included verbatim in this script. This option is used to make common functions accessible by several scripts.

FIG. 21 shows an example of a header. The first header line 2205 defines the name "Scripted End of Day" using the "#SCRIPT_NAME" header. The second header line 2210 specifies that the report is an End of Day report that should print when the End of Day button is pressed on the LCD using the "#REPORT_TYPE" and "END OF DAY" header. The third line 2215 "#INTERVAL BY_BUSINESS_DAY_WITH_SHIFTS" specifies the report data covers a single business day broken up by shifts. The fourth line 2220 specifies that the report belongs to the family labeled "KASPER" using the "#FAMILY" header.

FIG. 22 shows a second example of a header. The script name is defined in the first line of the header 2305 as "Reprint End of Shift". The second line 2306 means that this report type is a screen report that displays on the screen using the "#REPORT_TYPE SCREEN" header. The third line 2307 uses "#INTERVAL BY_BUSINESS_DAY_WITH_SHIFTS" to specify a single business day broken up by shifts for the report. The fourth line 2308 designates the report as belonging to the family labeled "ORIGINAL" using the "#FAMILY" header. The fifth line 2309 permits the clerk to print the report using the "#CLERK_PRINT" header. The sixth line 2310 "#BY_USER" allows the clerk to specify if the report is for everyone or a specific user.

The script program supports the following BASIC features:

1) print, println
2) if, else
3) begin, end
4) while
5) OR, AND (e.g. logical statements)
6) < > (e.g. comparison statements "less than" and "greater than")
7) Functions (e.g. with parameters included)
8) Comments, #

These features of BASIC have been altered for the script program:

1) == (e.g equality operator)
2) != (e.g inequality operator)

There are additional commands found in the script program. These commands used are case-insensitive and are recognized regardless of the case used for these keywords. Some of the commands can take multiple parameters and are separated by commas. The commands are shown below in Table 1.

TABLE 1

Script Commands and Parameters

| COMMAND | PARAMETERS | EXAMPLES |
|---|---|---|
| FORMAT | Text: [NORMAL\|BOLD] Precision: [number], [C\|F\|N\|I] | format bold<br>format 10, c |
| IDENT | Precision: [number] | Ident 3 |
| MOVE | From [OUTSIDE\|DROP\|RESERVE\|CTRAY\|POSADJUST\|ALL]<br>To [OUTSIDE\|DROP\|RESERVE\|CTRAY\|TUBELOAD\|NEGADJUST\|DROPOFF\|ALL]<br>Currency | MOVE (outside, drop, all, value)<br>MOVE (reserve, negadjust, check, count) |

TABLE 1-continued

Script Commands and Parameters

| COMMAND | PARAMETERS | EXAMPLES |
|---|---|---|
| | [CASH\|CHECK\| OTHER\|ALL] Value or Count [VALUE\|COUNT] | |
| MOVE__INTERVAL | From [OUTSIDE\| DROP\|RESERVE\| CTRAY\|POSADJUST\| ALL] To[OUTSIDE\|DROP\| RESERVE\|CTRAY\| TUBELOAD\| NEGADJUST\| DROPOFF\|ALL] Currency [CASH\| CHECK\|OTHER\|ALL] Value or Count [VALUE\|COUNT] Interval [Numeric value, 0] | MOVE__INTERVAL (outside, drop, checks, value, 0) |
| MOVE__PERSON | From [OUTSIDE\| DROP\|RESERVE\| CTRAY] POSADJUST\| DROPOFF\|ALL] To[OUTSIDE\|DROP\| RESERVE\|CTRAY\| TUBELOAD\| NEGADJUST\| DROPOFF\|ALL] Currency [CASH\| CHECK\|OTHER\|ALL] Value or Count [VALUE\|COUNT] Person [Numeric value, 0] | MOVE__PERSON (outside, all, other, value, 1287) |
| MOVE__ INTERVAL__ PERSON | From [OUTSIDE\| DROP\|RESERVE\| CTRAY\|POSADJUST\| DROPOFF\|ALL] To [OUTSIDE\|DROP\| RESERVE\|CTRAY\| TUBELOAD\| NEGADJUST\|ALL] Currency [CASH\| CHECK\|OTHER\|ALL] Value or Count [VALUE\|COUNT] Interval [Numeric value, 0 indexed] Person [Numeric value, 0 indexed] | Move__Interval__ Person (drop, ctray, all, value, 4, 1287) |
| CONTENT | Where [DROP\| RESERVE\|CTRAY\| ALL] Currency [CASH\| CHECK\|OTHER\|ALL] | CONTENT (DROP, CHECK) |
| BALANCE | Where [DROP\| RESERVE\|CTRAY\| ALL] Currency [CASH\| CHECK\|OTHER\|ALL] | BALANCE (RESERVE, CASH) |
| ACCEPTOR | Type [FANCY\| VALUE\|CURRENT\| START\|WITHDRAW] Fancy type [CURRENT\|VALUE] | ACCEPTOR (VALUE) ACCEPTOR (FANCY, CURRENT) |
| ACCEPTOR__ INTERVAL | Interval (Numeric value, 0 indexed] Optional parameter: [Fancy\|Count] | Acceptor__Interval (4) Acceptor__Interval (0, Fancy) |
| ACCEPTOR__ PERSON | Person[Numeric value,0 indexed] Optional parameter: [Fancy\|Count] | ACCEPTOR__ PERSON (1287) |
| ACCEPTOR__ INTERVAL__ PERSON | Interval[Numeric value,0 indexed] Person [Numeric value, 0 indexed] Optional parameter: [Fancy\|Count] | Acceptor__Interval__ Person (2, 1287) Acceptor__Interval__ Person (0, 1287, Count) |
| TIME | Which time [START\| STOP] | TIME (START) |
| TIME__INTERVAL | Which time [START\| STOP] Interval [Numeric value, 0 indexed] | TIME__INTERVAL (start, 0) |
| TUBE | Type [FANCY\| CURRENT\|START\| TUBE__T__VEND\| TUBE__T__FAIL\| TUBE__T__CLOAD\| TUBE__T__MLOAD\| TUBE__T__DUMP\| TUBE__T__POSADJ\| TUBE__T__NEGADJ\| TUBE__T__NOVEND\| TUBE__T__EMVEND\| TUBE__T__WRVEND] Fancy type [CURRENT\|ALL\| STOP] (for FANCY only) Tube activity type [COUNTY\| VALUE] (not used for FANCY, CURRENT, OR START) | TUBE (FANCY, ALL) TUBE (TUBE__T__ DUMP, COUNT) |
| TUBE__INTERVAL | Interval[Numeric value,0 indexed] Type [FANCY\| TUBE__T__VEND\| TUBE__T__FAIL\| TUBE__T__CLOAD\| TUBE__T__MLOAD\| TUBE__T__DUMP\| TUBE__T__POSADJ\| TUBE__T__NEGADJ\| TUBE__T__NOVEND\| TUBE__T__EMVEND\| TUBE__T__WRVEND] Activity type [COUNT\|VALUE] (not used for FANCY) | TUBE__INTERVAL (3, FANCY, VALUE) TUBE__INTERVAL (3, TUBE__T__NOVEND, COUNT) |
| TUBE__PERSON | Person[Numeric value,0 indexed] Type [FANCY\| VALUE\| TUBE__T__VEND\| TUBE__T__FAIL\| TUBE__T__CLOAD\| TUBE__T__MLOAD\| TUBE__T__DUMP\| TUBE__T__POSADJ\| TUBE__T__NEGADJ\| TUBE__T__NOVEND\| TUBE__T__EMVEND\| TUBE__T__WRVEND] Activity type [COUNT\| VALUE] (not used with FANCY or VALUE types) | TUBE__PERSON (1287, TUBE__T__VEND, VALUE) |
| TUBE__INTERVAL__ PERSON | Interval[Numeric value,0 indexed] Person[Numeric value,0 indexed] Type [FANCY\| VALUE\| TUBE__T__VEND\| TUBE__T__FAIL\| TUBE__T__CLOAD\| TUBE__T__MLOAD\| | Tube__Interval__ Person(3, 1287, Fancy) Tube__Interval__ Person(3, 1287, Value) Tube__Interval__ Person(3, 1287, TUBE__T__DUMP, VALUE) |

TABLE 1-continued

Script Commands and Parameters

| COMMAND | PARAMETERS | EXAMPLES |
|---|---|---|
| | TUBE_T_DUMP\| TUBE_T_POSADJ\| TUBE_T_NEGADJ\| TUBE_T_NOVEND\| TUBE_T_EMVEND\| TUBE_T_WRVEND] Activity type [COUNT\| VALUE] (not used with FANCY or VALUE types) | |
| NUMBER_OF | Type [INTERVAL, PERSON] Optional parameter: Interval [Numeric value, 0 indexed] | NUMBER_ OF(PERSON) NUMBER_ OF(PERSON, 2) |
| BOUNDED | Type [START\|STOP] Optional parameter: Interval [Nueric value, 0 indexed] | BOUNDED(STOP) BOUNDED(START, 2) |
| PERSON_NAME | Person[Numeric value, 0 indexed] | PERSON_NAME (1287 |
| INTERVAL_OF_ INTEREST | NONE | INTERVAL_OF_ INTEREST |
| PROGRESS | Textual progress [Text value or literal demarcated by quotes] | Progress (myTextVariable) Progress("Checkpoint 1 reached") |
| NOTATION | Interval or type [COUNT\|Numeric value, 0 indexed] | |

For the FORMAT command, the first type, which appears either "normal" or "bold" as keyword parameters, indicate if the text that follows should be printed in boldface or normal ink. The second type, which accepts two parameters, indicates how numbers should be formatted. 'c' indicates that numbers should be regarded as cents, and printed in the form appropriate for the country that the safe is located (e.g. "$4.56" in the US or "4,56 €" in Germany). 'n' indicates that numbers should be regarded as cents, but suppresses any currency symbols (e.g. 4.56). 'n' indicates that numbers are expected to be whole dollars (or Euros, etc.), and that decimals should be suppressed (e.g. 400 prints as 4). 'i' indicates that numbers are whole, and that decimals should be suppressed (e.g. 456 prints as 456). The IDENT command prints all following lines indented by a number of spaces equal to the precision.

Using the MOVE command, if VALUE is specified, it returns the value, in cents, of money moved from the specified location to the specified location. If COUNT is specified, it returns the number of movements from the specified location to the specified location. POSADJUST (e.g. Positive adjustment corrections that increase the value of the drop, reserve, or courier tray) can only appear in the From parameter and not in the To parameter. DROPOFF (e.g. funds left by the courier) can only appear in the From parameter. This parameter is a special case and is also subsumed into the Move (Outside, Reserve, Cash) value. TUBELOAD (e.g. funds used to load the tubes), an only appear in the To parameter. This is also a special case subsumed into the Move (Reserve, Outside, Cash) value. NEGADJUST (e.g. negative adjustment corrections that decrease the value of the drop, reserve, or courier tray) can only appear in the To parameters, not the From parameter. In the first example given in the table, MOVE (Outside, Drop, All, Value), the value, in cents, is returned for all manual vault drops. In the second example, MOVE (Reserve, Negadjust, Check, Count), retrieves the number of negative adjustments performed on checks within the reserve.

The MOVE_INTERVAL command works like MOVE, but is used to determine movement within a specified interval. Note that a variable can be used to specify the interval, making this command usable within a "while" loop. The example, Move_interval (Outside, Drop, Checks, Value, 0), retrieves the value in cents of all checks dropped in the first shift. The MOVE_PERSON also works like MOVE, but this command is used to determine movement by a specific person. A variable can be used to specify the person, making this command usable within a "while" loop. In the example, Move_Person (Outside, All, Other, Value, 1287) will return the value in cents of all non-cash, non-check money that the person specified by the person identifier "1287" moved from the outside to any other place in the safe.

This command MOVE_INTERVAL_PERSON works like MOVE, but is used to determine movement by a specific person within an interval, such as the third person in the second shift. Note that a variable can be used to specify the person, making this command usable within a "while" loop. In the example, Move_Interval_Person (Drop, Ctray, All, Value, 4, 1287) returns the value in cents of all money moved from the drop to the courier tray by the person specified by "1287" within the last four shifts.

The CONTENT command returns the value, in cents, of the specified currency type that is currently in the drop safe at the specified location. In the example, CONTENT (DROP, CHECK), the value of the checks in the drop vault is returned. The BALANCE command returns the value, in cents, of the specified currency type, that was in the safe at the specified location at the start of the time period covered by the report. The example, BALANCE (RESERVE, CASH), returns the value of the cash in the storage vault.

The ACCEPTOR command vanes widely depending upon the parameters. ACCEPTOR(Value) returns the value, in cents, of all bill acceptor deposits in the time period covered by the report. ACCEPTOR(Current) returns the value, in cents, of the total bill acceptor contents ACCEPTOR(Start) returns the value, in cents, of the total bill acceptor contents at the start of the time period covered by the report. ACCEPTOR (Withdraw) returns the value, in cents, of all bill acceptor withdrawals in the time period covered by the report. ACCEPTOR (Fancy, Current) returns a textual description of the current contents of the bill acceptors. ACCEPTOR(Fancy, Value), returns a textual description of all bill acceptor deposits in the time period covered by the report. If the report is for MANAGER_PICKUP, then only acceptor transactions associated with the vault serviced by the manager will be considered for the ACCEPTOR function.

The ACCEPTOR_INTERVAL command also varies depending upon the parameter. If the optional parameter, Fancy, is present, then the return value is text describing all bill acceptor deposits during the specified interval. If the optional parameter, Count, is present, then the return value is the number of bills accepted during the specified interval. If the optional parameter is not present, then the return value is the cent amount of all bill acceptor deposits during the specified interval.

For the ACCEPTOR_PERSON command, if the optional parameter, Fancy, is present, then the retrieved value is text describing all bill acceptor deposits by the specified person. If the optional parameter, Count, is present, then the retrieved value is the number of bills accepted by the specified person during the time period of the report. If the optional parameters are not present, the retrieved value, in cents, is all bill acceptor deposits by the specified person during the specified interval.

For the ACCEPTOR_PERSON_INTERVAL command, if the optional parameter, Fancy, is present, then the return value is text describing all bill acceptor deposits during the specified interval for the specified person. If the optional parameter, Count, is present, then the return value is the number of bills accepted by the specified person during the specified interval. If no optional parameter is present, the command returns the value, in cents, of all bill acceptor deposits by the specified person during the specified interval.

The TIME command returns a string representing the start, or stop, of the time period covered by the report formatted to local time standards. TIME_INTERVAL returns a string representing the start, or stop, of the time period specified by the interval formatted to local standards.

The TUBE command retrieves significantly different values based upon its parameters. TUBE(FANCY, CURRENT) returns a textual description of all tubes currently in the safe in tabular format. The table does not have headers, so it is up to the script author to use the "print" or "printin" BASIC statement to generate and print the headers. The table has four vertical entries, or columns. The first entry is the column number (1, 2, 3, 4, etc.). The second entry is the number of tubes held in that column of the motovend. The third entry is the value of a single tube within the column, in cents. The fourth entry is for the value of all tubes within the column, in cents. TUBE(FANCY, STOP) returns a textual description of all tube contents at the end of the report period. TUBE (FANCY, ALL) returns a textual description of all tube activity during the time period covered by the report.

The parameter TUBE_T_VEND returns the count, or value in cents (depending upon activity type), of all tubes vended in the report period. The parameter TUBE_T_FAIL returns the count, or value in cents (depending upon activity type), of all tube vend failures during the report period. The parameter TUBE_T_CLOAD returns the count, or value in cents (depending upon activity type), of all clerk tube loads in the report period. The parameter TUBE_T_MLOAD returns the count, or value in cents (depending upon activity type), of all manager tube loads during the report period. The parameter TUBE_T_DUMP returns the count, or value in cents (depending upon activity type), of all tube dumps during the report period.

The parameter TUBE_T_POSADJ returns the count, or value in cents (depending upon activity type), of all positive adjusts during the report period. The parameter TUBE_T_NEGADJ returns the count, or value in cents (depending upon activity type), of all negative adjusts during the report period. The parameter TUBE_T_NOVEND returns the count, or value in cents (depending upon activity type), of all no-vend incidents during the report period. The parameter TUBE_ T_EMVEND returns the count, or value in cents (depending upon activity type), of all empty-vend incidents during the report period. The parameter TUBE_T_WRVEND returns the count, or value in cents (depending upon activity type), of all wrong-vend incidents during the report period.

TUBE(CURRENT) returns the value, in cents, of all tubes currently in the motovend. TUBE(START) returns the value, in cents, of all tubes in the safe at the start of the time period covered by the report.

The TUBE_INTERVAL command is similar in operation to the TUBE command and retrieves significantly different values based upon its parameters. TUBE_INTERVAL (3, FANCY) returns a textual description of all tube activity during the specified interval (e.g. 3 shifts), and this type does not require the COUNT/VALUE activity type parameters. The information will be in tabular format showing four vertical entries, or columns. The first entry is the column number (1, 2, 3, 4, etc.). The second entry is the number of tubes held in that column of the motovend. The third entry is the value of a single tube within the column, in cents. The fourth entry is for the value of all tubes within the column, in cents.

The parameter TUBE_T_VEND returns the count, or value in cents (depending upon activity type), of all tubes vended in the specified interval. The parameter TUBE_T_FAIL returns the count, or value in cents (depending upon activity type), of all tube vend failures during the interval. The parameter TUBE_T_CLOAD returns the count, or value in cents (depending upon activity type), of all clerk tube loads in the interval. The parameter TUBE_T_MLOAD returns the count, or value in cents (depending upon activity type), of all manager tube loads during the interval. The parameter TUBE_T_DUMP returns the count, or value in cents (depending upon activity type), of all tube dumps during the interval.

The parameter TUBE_T_POSADJ returns the count, or value in cents (depending upon activity type), of all positive adjusts during the interval. The parameter TUBE_T_NEGADJ returns the count, or value in cents (depending upon activity type), of all negative adjusts during the interval. The parameter TUBE_T_NOVEND returns the count, or value in cents (depending upon activity type), of all no-vend incidents during the interval. The parameter TUBE_T_EMVEND returns the count, or value in cents (depending upon activity type), of all empty-vend incidents during the interval. The parameter TUBE_T_WRVEND returns the count, or value in cents (depending upon activity type), of all wrong-vend incidents during the interval. The parameter COUNT and VALUE specify whether the information displayed is by count of tubes or value of the tubes.

The TUBE_PERSON command also operates similarly to the TUBE command to retrieve tube vending activity by person. The TUBE_PERSON(1287, FANCY) command returns a textual description of all tube activity performed by the person specified by 1287. TUBE_PERSON (1287, VALUE) returns a 1 if the person performed any tube activity; 0 otherwise.

The parameter TUBE_T_VEND returns the count, or value in cents (depending upon activity type), of all tubes vended by the specified person during the report period. The parameter TUBE_T_FAIL returns the count, or value in cents (depending upon activity type), of all tube vend failures by the specified person during the report period. The parameter TUBE_T_CLOAD returns the count, or value in cents (depending upon activity type), of all clerk tube loads by the specified person during the report period. The parameter TUBE_T_MLOAD returns the count, or value in cents (depending upon activity type), of all manager tube loads by the specified person during the report period. The parameter TUBE_T_DUMP returns the count, or value in cents (depending upon activity type), of all tube dumps by the specified person during the report period.

The parameter TUBE_T_POSADJ returns the count, or value in cents (depending upon activity type), of all positive adjusts by the specified person during the report period. The parameter TUBE_T_NEGADJ returns the count, or value in cents (depending upon activity type), of all negative adjusts by the specified person during the report period. The parameter TUBE_T_NOVEND returns the count, or value in cents (depending upon activity type), of all no-vend mcidents by the specified person during the report period. The parameter TUBE_T_EMVEND returns the count, or value in cents (depending upon activity type), of all empty-vend incidents by the specified person during the report period. The parameter TUBE_T_WRVEND returns the count, or value in cents (depending upon activity type), of all wrong-vend incidents by the specified person during the report period.

The TUBE_INTERVAL_PERSON operates similarly to the TUBE command to retrieve tube vending activity by interval and person. The TUBE_INTERVAL_PERSON(3, 1287, FANCY) command returns a textual description of all tube activity performed by the person specified by 1287 during the interval specified by 3 (e.g. 3 shifts). TUBE_INTERVAL_PERSON (3, 1287, VALUE) returns a 1 if the person performed any tube activity in the interval; 0 otherwise.

The parameter TUBE_T_VEND returns the count, or value in cents (depending upon activity type), of all tubes vended by the specified person during the interval. The parameter TUBE_T_FAIL returns the count, or value in cents (depending upon activity type), of all tube vend failures by the specified person during the interval. The parameter TUBE_T_CLOAD returns the count, or value in cents (depending upon activity type), of all clerk tube loads by the specified person during the interval. The parameter TUBE_T_ MLOAD returns the count, or value in cents (depending upon activity type), of all manager tube loads by the specified person during the interval. The parameter TUBE_T_DUMP returns the count, or value in cents (depending upon activity type), of all tube dumps by the specified person during the interval.

The parameter TUBE_T_POSADJ returns the count, or value in cents (depending upon activity type), of all positive adjusts by the specified person during the interval. The parameter TUBE_T_NEGADJ returns the count, or value in cents (depending upon activity type), of all negative adjusts by the specified person during the interval. The parameter TUBE_T_NOVEND returns the count, or value in cents (depending upon activity type), of all no-vend incidents by the specified person during the interval. The parameter TUBE_T_EMVEND returns the count, or value in cents (depending upon activity type), of all empty-vend incidents by the specified person during the interval. The parameter TUBE_T_WRVEND returns the count, or value in cents (depending upon activity type), of all wrong-vend incidents by the specified person during the interval.

For the NUMBER_OF command, if INTERVAL is the first parameter, this function returns the number of intervals in the report (days or shifts). If PERSON is the first parameter, this function returns the number of people performing actions during the report period. If PERSON is the first parameter, and another parameter follows, the second parameter is interpreted as an interval number, and the number of people performing actions within the specified interval is returned.

The BOUNDED command is used on business day reports, and indicates if the report's period was bracketed at the beginning or end by an end-of-day marker. The optional form indicates if a given interval was 'complete' at either the start or stop of the interval. For example, a report generated on an unclosed shift (i.e. the current shift) will compute BOUNDED(START) to be true, and BOUNDED(STOP) to be false.

The PERSON_NAME function returns the name of the person referred to by the parameter. For the example, PERSON_NAME(1287), the name of the employ specified by the numeric value of "1287" is retrieved. The INTERVAL OF INTEREST command is useful only for a single shift within a business day report. It is used to determine which shift (interval) the report should be acting on. The PROGRESS function will display the script's progress on the screen as it is executed by using this function. For the NOTATION command, if COUNT is the first parameter, then this function returns the number of notations made by the safe within the time period of the report. Otherwise, the function returns the text of the notation specified by the index.

Each of the previously described reports can be generated using the report script generating program. Other example reports are shown in FIGS. 23-28. FIG. 23 shows an example for a Courier Withdrawal transaction report showing the amount of currency picked up by a courier and breaks the receipts down by category. The report 2300 includes the name of the report 2301, an identifier for the store 2302, the print date of the report 2304, the courier's, manager's, or other user's name/identifier printing the report 2305, the date range 2306 of receipts in the pickup, total value of the pickup 2310, amount of cash in the courier tray 2315, the value of the checks in the courier tray 2317, the contents of the bill acceptor 2320 (e.g. Bill Acceptor Counts) broken down by denomination to list number of bills in each acceptor 2321, total number in each bill acceptor 2322, and total value in each 2333. The collective totals number of each denomination are listed in another entry column 2335, and the total value for each denomination is also shown 2336. There is also a total bill count 2337 and a total currency value 2338.

Receipts are further broken down by business day 2340. There is a partial day entry at 2341 with receipts for the day listed. Acceptor cash 2342 lists the cash in the bill acceptor for the time period. Courier tray cash deposits 2343 shows the amount of cash deposited in the courier tray. Courier tray check deposits 2344 shows the amount of cash deposited in the courier tray. The total deposits 2345 is also shown. There is a complete business day listing at 2346 that is also broken down to show acceptor cash 2347, courier tray cash deposits 2348, courier tray check deposits 2349, and total deposit value 2350. Other business day listings are shown at 2351, 2352, 2353, and 2354. Partial day listing 2354 shows the amount of deposits as or the courier pickup. The previous partial day listing 2341 marks the time of the previous courier pickup. There is also an end of courier report 2355 entry. This report can be used as a receipt from the store to a courier detailing the receipts picked up by a courier.

The Current Content Report in FIG. 24 shows the current contents of the drop safe in each vault and the bill acceptors. The report 2400 includes the name of the report 2401, an identifier for the store 2402, the date the report was printed 2403, and the name 2404 of the user requesting the report. The current amount of cash in the drop vault is shown at 2405 broken down by cash 2406, by check 2407, and total 2408. The current amount in the storage or reserve vault (e.g. Current Reserve Change Fund) is shown at 2409 broken down by cash 2410, by check 2411, and total 2412. The amount in the courier tray 2413 is shown at 2413 broken down by cash 2414, by check 2415, and total 2416.

The amount of currency in the motovend column is shown as Column Content 2420. Each column 2421 is listed, with the tube count of each column 2422, the designated value of each tube 2423, and the total value of the currency in each column 2424. There is also an entry line for total tube count and value 2425. The current content of the bill acceptors is also shown as Bill Acceptor Contents 2430. The contents by denomination for acceptor 1 2431 and acceptor 2 2432 is shown with the number of each bill denomination listed. The total number of each denomination 2433 is listed, with the total value for each denomination 2434 also listed. The total bill count 2335 for each acceptor is also shown, and the total value 2436 for each acceptor listed. There is also an entry for the total number of bills in both acceptors 2347 and the total value of the bills contained 2438. There is also an entry for any unrecognized bills deposited 2439 and an end of the report 2440.

FIG. 25 shows a Shift Report 2500 under the script program used to provide accounting information for a shift to show deposit and withdrawal activity from the safe during a specified shift for each user programmed into the CPU and making a transaction. The report 2500 includes a report identifier 2501 for the report, a store identifier 2502, the time and date 2403 the report was printed, the date and time range 2504 covered by the report, the user identifier for the user printing the report 2506, and the version of the report or software 2505.

The report is broken down by shifts and there is a shift identifier 2507 and the date and time range 2508 covered by the shift, the name of the clerk/cashier 2509 making the listed transactions, the number and value of tubes loaded 2510, the number and value of tubes vended 2511, the number and value 2512 of bills fed into the acceptor, the number and value of vault drops 2513 (e.g. none were made for this user), drop withdrawals-adjusted 2514, reserve withdrawals-adjusted 2515, and courier tray deposits-adjusted 2516.

The tubes vend information is further broken down into vend details 2517. This includes the number of tube vends from each column and total value 2518 and the number of manager tube loads for each column and total value 2519. The bills acceptor is broken down into a record of the bills accepted 2520. This includes the denominations of the bills 2521, the number of each denomination deposited 2522, and the total value of the deposited currency 2523. There is also a row for the number of unrecognized bills deposited 2524 and for all bills deposited 2525. There is an entry for the total value of the bills deposited 2526.

There is also an entry for a courier visit 2530. There is a data entry for tubes loaded 2531, for tubes vended 2532, for bills accepted 2533, for vault drops 2534 (e.g. none in this example), and courier tray withdraw-adjust 2535. There is also an entry for tube activity details 2536 and bills accepted in the bill acceptor 2537. The information given above is also provided for a second clerk Elaine 2540. There is a data entry for the total deposit for shift 1 2541 showing the total amount deposited into the safe, the total number of bills accepted 2542, and vault drops 2543 (e.g. no vault drops in the example).

Each shift for each clerk logged into the system is listed on the report. For shift 2, there is a listing for Ben 2545, Elaine 2550, and Les 2555. There is also a summary for shift 2 2556. There is also a summary for all shifts 2560 showing the total deposits all shifts 2561, the total count and value of bills deposited in the bill acceptor 2562, and vault drops 2563. There is also and end of shift report entry 2565.

FIG. 26 shows an example of a Summary Report 2600 that can be implemented using the script program to show deposit and withdrawal activity from the safe during a specified period. The report 2600 includes an identifier 2601 for the report, an identifier for the store 2602, the date and time the report is printed 2603, the user printing the report 2604, the software or report version 2605, the date range 2606 covered by the report. Beginning balances 2610 are shown that are the total amounts in the safe at the time the End of Day was performed that ended the prior reporting period and include entries for the beginning tube balances 2611, main vault balances 2612, drop vault balances 2613, courier tray balances 2614, bill acceptor balances 2615. The net balances 2620 are the differences between what was deposited into the safe versus what was withdrawn during the time period reported for the net tubes 2621, the net tubes adjust 2622, the net drop vault 2623, the net main vault 2624, the net courier tray 2625, and the net bill acceptors 2626.

Deposits 2630 shows deposits made into the safe during the time period reported and includes number of tubes and value loaded by the clerk 2631, number of tubes and value loaded by the manager 2632, positive adjustments by the manager for tubes 2633, cash drops 2635, check drops 2636, other drops 2637, storage/main vault deposits 2638, courier tray deposits 2639, and bill acceptors 2640. Withdrawals 2645 show the withdrawals made from the safe during the time period reported cind includes the number and value of the tubes vended 2641, the number and value of tubes dumped 2642, negative adjustments by the manager for tubes 2643, drop vault withdrawals 2644, storage/main vault withdrawals 2646, courier tray withdrawals 2647, and bill acceptor withdrawals 2648.

Column Activity 2650 tracks the motovend activity by tube column. The first line entry 2651 is the number of vends from each column, the total number of vends, and value of the vends. The second line entry 2652 is for the number of failures in each column, the total number of failures, and the value. The third line entry 2653 is for the number of clerk tube loads into each column, the total number of clerk tube loads, and the value. The fourth line entry 2656 is for the number of positive adjustments for each column, the total adjustments, and the value. The ftfth line entry 2657 is the number of negative adjustments for each column, the total adjustments, and the value. The sixth line entry 2658 is the number of no vends recorded for each column, the total no vends logged, and the total value. The seventh line entry 2659 is the number of empty vends logged for each column, the total number of empty vends, and the total value. The eighth entry line 2660 is the number of wrong vends for each column, the total number of wrong vends, and the value.

The Bill Acceptor Activity 2665 lists the contents in each of the bill acceptors. The first line entry 2661 is the number of $1 bills in each bill acceptor, the total number, and total value. The second line entry 2662 is for the number $2 bills in each acceptor, the total number of bills, and the value. The second line entry 2662 is for the number $2 bills in each acceptor, the total number of bills, and the value. The third line entry 2663 is for the number $5 bills in each acceptor, the total number of bills, and the value. The fourth line entry 2664 is for the number $10 bills in each acceptor, the total number of bills, and the value. The fifth line entry 2666 is for the number $20 bills in each acceptor, the total number of bills, and the value. The sixth line entry 2667 is for the number of $50 bills in each acceptor, the total number of bills, and the value. The seventh line entry 2668 is for the number of $100 bills in each acceptor, the total number of bills, and the value. The eighth line entry 2669 is for the number of unrecognized bills in each acceptor. The ninth entry line 2670 is for the total number of bills in each acceptor and the value. And the tenth line 2671 is the value of bills in each acceptor and the total value.

There are also entries for the each of the clerks. Data entries for Ben 2675 show the number of bills accepted in the bill acceptor 2676, the number of bills accepted 2677, and the number of tubes loaded 2678. Data entries for Elaine 2680 show the number of bills accepted in the bill acceptor 2681, the number of bills accepted 2682, and the number of tubes loaded 2683. Data entries for Les 2690 show the number of bills accepted in the bill acceptor 2691, the number of bills accepted 2692, and the number of tubes loaded 2693. There is an identifier for the end of the report 2691.

FIG. 27 shows an example of an End of Day Report 2700 that can be implemented using the script program. The report 2700 includes an identifier 2701 for the report, an identifier for the store 2702, the date and time the report is printed 2703, the period of time covered by the report 2704, the version of the software or report 2705, and the user printing the report 2706. The value of the bills accepted by the bill acceptor 2707, the total value of vault drops 2708, and the total value of bills and vault drops 2709 are shown. The deposits into the courier tray 2710 broken down by total value 2711, cash 2712, and check 2713 are shown. There is also a break down by shifts. Shift 1 2715 is shown by bills accepted 2716, vault drops 2717, and total of bills and vault drops 2718. Shift 2 2720 is shown by bills accepted 2721, vault drops 2722, and total of bills and vault drops 2723. There is also and end of report indicator 2724.

FIG. 28 shows an End of Shift Report 2800 generated using the script program and used to provide accounting information at an End of Shift closeout to show deposit and withdrawal activity from the safe during a shift. The report 2800 includes a report identifier 2801 for the report, a store identifier 2802, the time and date 2803 the report was printed, the date and time range 2804 covered by the report, and the version of the report or software 2805, and the user printing the report 2806.

The shift identifier 2807 identifies the shift and includes the date and time range 2808 covered by the shift. There is an entry for each clerk. The first entry is name of the clerk/cashier 2810 making the listed transactions. The number and value of tubes loaded 2811, the number and value of tubes vended 2812, the number and value 2813 of bills fed into the bill acceptor, the number and value of vault drops 2814 (e.g. none were made for this user), drop withdrawals-adjusted 2815, reserve withdrawals-adjusted 2816, and courier tray deposits-adjusted 2817.

The tubes vend information is further broken down into vend details 2819. This includes the number of tube vends from each column and total value 2820, and the number of manager tube loads for each column and value 2821. The bills acceptor is broken down into a record of the bills accepted 2822. This includes the denominations of the bills 2823, the number of each denomination deposited 2824, and the total value of the deposited currency 2823. There is also a row for the number of unrecognized bills deposited 2827 and for all bills deposited 2828. There is an entry for the total value of the bills deposited 2826.

There is also an entry for a courier visit 2830. There is a data entry for tubes loaded 2831, for tubes vended 2832, for bills accepted 2833, for vault drops 2834 (e.g. none in this example), and courier tray withdraw-adjust 2835. There is also an entry for tube activity details 2836 and bills accepted in the bill acceptor 2837. The information given above is also provided for a second clerk Elaine 2840. There is a data entry for the total deposit for the shift 2841 showing the total amount deposited into the safe, the total number of bills accepted 2842, and vault drops 2843 (e.g. no vault drops in the example). There is an end of report indicator 2844.

Referring back to FIG. 4, the next function controlled by the CPU operating software is vending control 425. The CPU controls the motovend vending mechanism. The vending, or dispensing, of tubes (e.g. coin rolls) is controlled according to a series of rules. Tubes can be dispensed with no interval if the main vault door is open (a.k.a. "dumping"). Typically, the interval between two vends is no less than 2 minutes, but the software supports an "Alternate Vend Time" which can shorten or lengthen the interval. There is also a "Time of Day Vend" option that associates a different vend interval with a time period. For example, 'rush hour' can be set with a shorter vend interval, while 'after 10 PM' can be set with a longer vend interval. Also, each user account can be set with a vend limit so that if a given tube's value contents exceed the user's vend limit, that user cannot vend that tube.

The next CPU software 400 feature is the LCD (e.g. liquid crystal display) 430. The CPU, and thus the drop safe, is controlled through a LCD touch-sensitive screen. The software 400 creates a series of hierarchical screens with labeled buttons on the LCD 430. Buttons of a similar nature (e.g. "Cancel", "Save", etc.) are always placed in the same position to make operation more intuitive. The buttons are also made as large as possible to reduce the chances of pressing the incorrect button. Users press these buttons on the LCD 430 to make control and data inputs into the CPU software 400 controlling the computerized drop safe.

The next feature of the operating CPU software 400 on the CPU is hardware configuration 435. Upon initial startup, the drop safe CPU reads a configuration file indicating what sort of bill acceptors, printers, and network interfaces are present. The CPU then initializes the software subroutines necessary to communicate and control those devices. The configuration file's contents can be manipulated by a user with executive level hierarchy authorization.

User hierarchies 440 is another feature of the safe's CPU software 400. There are four hierarchy types of users with different control privileges: executive, manager, clerk, and courier. Executives have all privileges except for instant door opening. Managers have fewer privileges and abilities. Clerks have fewer still. Couriers have no privileges or abilities except the ability to instantly open vault doors. This hierarchical organization can be configured so as to bestow different activity authorizations for the various user types. As an example, these different authorizations options for clerks and managers include the following:

1. Clerk Authorization Options:

Can/can not load tubes (Sets whether a clerk can load tubes into the motovend)

Can/can not print reports (Sets whether a clerk can print reports)

Can/can not end business day (Sets whether a clerk can close-out the safe and accounting data at the end of a business day)

Can/can not end shift (Sets whether a clerk can close-out the safe and accounting data at the end of a business day)

2. Manager Authorization Options: The same as the clerk authorizations, plus:

Can/can not open vault doors (Sets whether a manager can open any of the vault doors)

Can/can not dump tubes (Sets whether a manager can perform a tube dump to vend all motovend tube contents)

Can/can not activate the alternate vend interval (Sets whether a manager can activate the alternate vend interval feature to delay vending operations by the time interval specified in the policy)

Can/can not activate the time-of-day vend interval (Sets whether a manager can activate the time-of-vend vend interval feature to delay vending operations by the time interval specified in the policy for specified times during the day)

Can/can not activate vault door lockout (Sets whether a manager can activate the vault door lockout feature to refuse vault access by anyone until an internal timer countdown completes because of unauthorized access attempt, lack of user permission, or a control input).

Can/can not add or delete edit clerk accounts (Sets whether the manager can edit clerk user accounts to either add or delete a clerk hierarchy level account).

Can/can not adjust tube counts (Sets whether the manager can edit the tube count using tube adjust command functions)

Can/can not adjust drop accounting (Sets whether the manager can edit the drop vault deposit accounting using drop adjust or vault move command functions)

Can/can not adjust reserve change fund accounting (Sets whether the manager can edit the reserve fund accounting using currency adjust or vault move command functions)

Can/can not adjust courier tray accounting (Sets whether the manager can edit the courier tray fund accounting using courier tray adjust or vault move command functions)

Every user account has a unique name, which generally should be based on the user's name. Executives can add and delete any other account type. Executives can only modify their own account, while managers can add or delete clerk or manager accounts, if so permitted. Clerks and courier cannot add other user accounts. Couriers may be limited to accessing the safe using a hardware identification signature such as a data access key or access card.

A very important feature of the CPU software 400 accounting and security protocols is the CPU's stored transaction records 445. Every action involving money or security creates a transaction record in a data file in memory of the CPU. Transaction files can only be destroyed by importing files from another safe. Almost every transaction record is associated with a user, making employee manipulations very difficult. The transaction files are used to audit the contents and transactions of the safe and generate financial or security reports.

Current counts 447 is another feature of the CPU 400 operating software. The CPU software 400 maintains a current counts record constantly updated in the memory. This data record contains the current currency, check, and other receipts inside the drop safe. This data record is constantly updated with transactions changing the current currency, check, and other receipts in the drop safe's vaults, the current tube counts, and the current bill acceptor contents. Current contents of the different component currency storage areas of the drop safe are maintained for each vault. Each of the two vaults' contents are tracked by currency type (e.g. cash, check, and other) and value of each. The motovend tube assembly contents are tracked by column count and value in each column. And the bill acceptor contents are tracked by denomination, count, and value. These files are constantly updated and tracked for each transaction and can be remotely accessed by either the modem or Ethernet connection.

Another security and accounting tool is the user identification 450 subroutine. Every executive, manager, and clerk account possesses a name associated with a unique PIN number. Most transactions involve a user making a positive identification to perform the transaction using the LCD and entering their name and unique PIN number to log into the system to make a currency or other transaction. Couriers generally do not have user names and PIN numbers accounts, but couriers can be assigned a hardware identification 'signature'. This signature corresponds to a physical item, such as a data key or card. The computerized drop safe has an installed electronic device, or data key reader, that validates the physical item to verify access to the safe. An advantage of using a hardware identification signature data key is the ability to use a programmable memory in the data key that can have transaction information copied (e.g. the Courier Report) for transportation back to the courier's office for receipting currency pickup.

The ability of the CPU software 400 to integrate with remote control and monitoring using a Point Of Sale Interface 455 is another important feature. The architecture of the CPU software 400 includes a point of sale (POS) interface to connect with the drop safe via the Ethernet and/or the modem, and the CPU can be accessed by this interface to perform tube vends, accept bills, load tubes, record vault drops, or securely access vault doors if the appropriate security measures are undertaken. Currency deposit information or other information stored on the CPU may also be accessed using this POS interface and allow real time, unscheduled transaction audits as another security enhancements.

There is also a back office interface 460 to the CPU software 400. The architecture of the software allows a back office application to connect to the CPU via either serial or Ethernet connection that is independent from the POS interface and allows similar capabilities under appropriate security measures. The CPU can supply transaction, configuration, or user information to the application, or accept such information using the application. This information can also include currency deposit information, and the data can be available using the POS and the back office interfaces.

The CPU software 400 also offers superior flexibility through the language 465 subroutines and data files. If supplied with the appropriate translation file, the software can be localized to a given country and dialect within that country through the use of language files. Localization will set all text on the screen to be displayed in the host country's language and a separate language setting sets the currency, currency formatting, date, and time formats to match the host country. Any non-executive account can also be set to use a translation file. For example, for a Hispanic employee the computerized drop safe can be set to display its screens in Spanish when that particular user logs in.

At startup, the software searches the file system for language files. Every language file contains a number indicating what region and dialect the file is for, and a series of numbers (the key) and strings (the desired text). The computerized drop safe also has a 'location language' that dictates what currency, date, and time format to use. The computerized drop safe also maintains a 'user language' that corresponds to the current user's preferred language, so individual users can have the display operate in their native or preferred language. The software has a 'mapping' of English strings and numbers such that each number corresponds with a given English string. Whenever the interface needs to display text, it uses another piece of software that uses a hash lookup to find the desired string.

While the invention has been particularly shown and described with respect to preferred embodiments, it will be readily understood that minor changes in the details of the invention may be made without departing from the spirit of the invention.

Having described the invention, we claim:

1. A central processing unit running control and security software for a drop safe comprising:

data inputs and control outputs for at least one vault door;

data inputs and control outputs for at least one motovend;

data inputs and control outputs for at least two bill acceptors;

data inputs to and data outputs from a touch sensitive display, said display data outputs controlling at least one vault door, at least one motovend, and at least two bill acceptors;

data and control inputs to the central processing unit from a modem or an Ethernet interface and data outputs from the central processing unit to the modem or Ethernet interface;

data outputs formatted using a report script generating program operating on the central processing unit that permits users to write customized reporting format program instructions;

a language subroutine operating on the central processing unit allowing localization of text to display a specific language or dialect and alter time, date, or currency display formats in reports and on the touch sensitive display; and wherein the central processing unit controls access to all vaults doors and records access to vaults into a non-volatile memory.

2. The central processing unit running control and security software for a drop safe of claim 1 wherein a user inputs data into the central processing unit such as a personal identification number on the touch sensitive display screen.

3. The central processing unit running control and security software for a drop safe of claim 2 wherein the user after entering a personal identification number into the central processing unit accesses at least one vault door to make a currency transaction recorded by the central processing unit to show the transaction, the value, the currency type, the user, and the vault into the memory.

4. The central processing unit running control and security software for a drop safe of claim 2 wherein the user after entering a personal identification number accesses the motovend to make a vend tube or deposit tube currency transaction recorded by the central processing unit to show the transaction, the vend or deposit value, and the user into the memory.

5. The central processing unit running control and security software for a drop safe of claim 2 wherein the user after entering a personal identification number into the central processing unit can access the bill acceptor to make a currency transaction recorded by the central processing unit to show the transaction, the value, the user, and bill denomination into the memory.

6. The central processing unit running control and security software for a drop safe of claim 5 wherein the bill acceptor includes an integrated denomination sensor providing denomination data on currency fed into the acceptor to the central processing unit.

7. The central processing unit running control and security software for a drop safe of claim 5 wherein the bill acceptor includes an integrated bill recycler and denomination sensor providing denomination data on currency fed into and out of the recycler to the central processing unit.

8. The central processing unit running control and security software for a drop safe of claim 5 wherein the bill acceptor is controlled to provide alternating deposit cycling of both acceptors to cycle deposits faster than 1.5 seconds.

9. The central processing unit running control and security software for a drop safe of claim 5 wherein the bill acceptor can be controlled by the modem or Ethernet interface.

10. The central processing unit running control and security software for a drop safe of claim 1 wherein secure access to the vault doors can be controlled using the modem or Ethernet interface.

11. The central processing unit running control and security software for a drop safe of claim 1 wherein data recorded by the central processing unit can be accessed using the modem or Ethernet interface.

12. The central processing unit running control and security software for a drop safe of claim 1 wherein generated reports can be accessed using the modem or Ethernet interface.

13. The central processing unit running control and security software for a drop safe of claim 1 wherein software operating on the central processing unit can be modified using the modem or Ethernet interface.

14. The central processing unit running control and security software for a drop safe for claim 1 wherein the central processing unit controls a video recorder.

* * * * *